US008110330B2

(12) United States Patent
Ishikawa et al.

(10) Patent No.: US 8,110,330 B2
(45) Date of Patent: Feb. 7, 2012

(54) TONER, DEVELOPER, TONER CONTAINER, PROCESS CARTRIDGE, IMAGE FORMING METHOD, AND IMAGE FORMING APPARATUS

(75) Inventors: Yoshimichi Ishikawa, Itami (JP); Chiyoshi Nozaki, Otsu (JP); Tsuyoshi Nozaki, Ikeda (JP); Takuya Kadota, Kobe (JP); Katsunori Kurose, Takarazuka (JP); Mitsuyo Matsumoto, Ibaraki (JP); Atsushi Yamamoto, Kawanishi (JP); Masahide Inoue, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1176 days.

(21) Appl. No.: 11/901,690

(22) Filed: Sep. 18, 2007

(65) Prior Publication Data

US 2008/0131797 A1 Jun. 5, 2008

(30) Foreign Application Priority Data

Sep. 19, 2006 (JP) ..... 2006-252328

(51) Int. Cl.
*G03G 9/08* (2006.01)

(52) U.S. Cl. ..... 430/108.6; 430/108.7; 430/110.3; 430/119.8; 430/119.88

(58) Field of Classification Search ..... 430/108.6, 430/108.7, 110.3, 119.8, 119.88, 123.5
See application file for complete search history.

(56) References Cited

U.S. PATENT DOCUMENTS

| | | | | |
|---|---|---|---|---|
| 6,022,661 | A * | 2/2000 | Kurose et al. | 430/108.7 |
| 6,929,893 | B2 * | 8/2005 | Yoshino et al. | 430/108.1 |
| 2002/0081514 | A1 * | 6/2002 | Ohba et al. | 430/111.32 |
| 2004/0029031 | A1 * | 2/2004 | Yamazaki et al. | 430/137.14 |
| 2004/0143036 | A1 * | 7/2004 | Takano et al. | 523/216 |
| 2006/0204882 | A1 | 9/2006 | Nozaki et al. | |
| 2006/0210902 | A1 | 9/2006 | Nakamura et al. | |
| 2006/0216623 | A1 * | 9/2006 | Matsumura et al. | 430/108.1 |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0166635 | A1 | 7/2007 | Yamamoto et al. | |
| 2007/0190442 | A1 | 8/2007 | Nakamura et al. | |
| 2007/0190443 | A1 | 8/2007 | Hagi et al. | |
| 2007/0207399 | A1 | 9/2007 | Kadota et al. | |
| 2007/0212630 | A1 | 9/2007 | Yasunaga et al. | |

FOREIGN PATENT DOCUMENTS

| | | |
|---|---|---|
| JP | 3195362 | 6/2001 |
| JP | 2001-324831 | 11/2001 |
| JP | 2001-343780 | 12/2001 |
| JP | 2002-116574 | 4/2002 |
| JP | 2002-196536 | 7/2002 |
| JP | 2003-515795 | 5/2003 |
| JP | 2004-170818 | 6/2004 |
| JP | 2005-49858 | 2/2005 |
| JP | 2005-275146 | 10/2005 |
| JP | 2007-71965 | 3/2007 |
| WO | WO97/01131 | 1/1997 |
| WO | WO01/40878 A1 | 6/2001 |

OTHER PUBLICATIONS

U.S. Appl. No. 11/624,525, filed Jan. 18, 2007.
U.S. Appl. No. 11/685,313, filed Mar. 13, 2007.
U.S. Appl. No. 11/685,890, filed Mar. 14, 2007.
U.S. Appl. No. 11/686,801, filed Mar. 15, 2007.
U.S. Appl. No. 11/687,352, filed Mar. 16, 2007.
U.S. Appl. No. 11/687,431, filed Mar. 16, 2007.
U.S. Appl. No. 11/696,879, filed Apr. 5, 2007.
U.S. Appl. No. 11/772,404, filed Jul. 2, 2007.
Japanese official action dated Dec. 20, 2011 in a corresponding Japanese patent application.

* cited by examiner

*Primary Examiner* — Janis L Dote
(74) *Attorney, Agent, or Firm* — Cooper & Dunham LLP

(57) ABSTRACT

To provide a toner that contains at least a binder resin, a colorant, a releasing agent and zeolite, the toner being manufactured through O/W type wet granulation and having an average circularity of 0.970 or greater, and a developer and image forming method using the toner.

9 Claims, 9 Drawing Sheets

TONER, DEVELOPER, TONER CONTAINER, PROCESS CARTRIDGE, IMAGE FORMING METHOD, AND IMAGE FORMING APPARATUS

BACKGROUND OF THE INVENTION

1. Technical Field

This disclosure relates to a toner used for development of an electrostatic image in electronic photography, electrostatic recording or electrostatic printing, and to a developer, toner container, process cartridge, image forming apparatus and image forming method using that toner.

2. Description of the Related Art

Contact heating-type fixing methods such as hot roller fixing have been widely used as methods for fixing toner. The fixing device used in hot roller fixing is equipped with a heating roller and a pressure roller. In the fixing device a recording medium (recording sheet) that bears thereon a visible image (toner image) is allowed to pass through the pressure contact area (nip area) between the heating roller and pressure roller, melting the toner image for fixation to the recording medium.

With a contact heating fixing method as typified by the hot roller fixing method, since fixing is accomplished by bringing the toner image on a recording sheet into contact with the surface of a heating member (e.g., heating roller) of the fixing unit (contact heating fixing device), it is necessary to prevent an offset phenomenon in which some toner particles of the toner image adhere to the heating member and smear the next recording sheet.

To solve this problem there is a known technique which coats or impregnates the heating roller and pressure roller of the fixing device with a fixing oil such as silicone oil or the like, but in view of demand for smaller fixing devices and lower costs, oilless fixing devices with no fixing oil application mechanism and fixing devices using smaller amounts of fixing oil have been employed. When utilizing this kind of fixing device, a releasing agent is added to the toner as an offset-preventing agent.

In the case of the heating fixing method, it is preferable for the heating temperature to be as low as possible in order to conserve energy, but if the heat characteristics of binder resin that constitute toner is designed too low in order to do so, the toner's heat resistance decreases and problems such as blocking occur. In order to realize both this low-temperature fixing property and heat resistance, it is advantageous to use a polyester resin in the binder resin. Compared to vinyl copolymer resins, polyester resins have low viscosity and high elasticity, so they are superior in low-temperature fixing properties while also having good heat resistance.

However, when a toner having a sufficient quantity of releasing agent that has been added to prevent offset is produced using a conventional pulverization method, a large amount of the releasing agent is exposed to the toner surface, leading to such problems as filming and blocking.

Meanwhile, so-called polymerization methods are known, such as suspension polymerization that involves polymerization of a polymerizable monomer in an aqueous medium, and emulsification aggregation wherein fine particles are produced by emulsion polymerization followed by aggregation. These polymerization methods can achieve a higher releasing agent content than the pulverization method. With regard to suspension polymerization, a structure-controlled toner is proposed that is produced by adding an additional polymerizable monomer for further polymerization after normal toner granulation (see Japanese Patent (JP-B) No. 3195362). In addition, with regard to emulsion aggregation, a structure-controlled toner is proposed that is produced by adding additional emulsified fine particles for aggregation after normal toner granulation by aggregation (see Japanese Patent Application Laid-Open No. 2002-116574).

However, both the suspension polymerization and emulsion aggregation methods accomplish polymerization in a aqueous medium and hence use a vinyl-based copolymer resin is used; thus it is difficult to employ polyester resins that undergo polymerization at high temperatures of around 200° C.

In addition, as a method for creating toner particles using polyester resin, a so-called solution suspension method is known wherein particles are created in an aqueous medium by dissolving a pre-polymerized resin in an organic solvent. In this method, the molecular weight of the resin during preparation becomes the molecular weight of the resultant toner. While it is common to mix a resin having a low molecular weight with a resin having a high molecular weight in order to adjust the toner's thermal properties, when a resin having a high molecular weight is introduced, it results in a problem such as poor toner granulation efficiency due to too high viscosity of solution containing the high molecular weight resin, thereby making it impossible to use a large amount of high molecular weight resin. For this reason, there is no choice but to increase the molecular weight of resin with a low molecular weight, which is disadvantageous for low-temperature fixing.

In order to overcome this problem there is a method that causes a modified polyester resin bearing reactive groups to undergo extension and crosslinking reactions after toner granulation, instead of introducing a resin with a high molecular weight. With this method it is possible to adjust the toner's thermal properties, but control of toner structure is insufficient, and the colorant, releasing agent and the like tend to be exposed to the toner surface. This method further presents a problem particularly in the case of development using a one-component developer that poor charging ability leads to toner deposition on the background of the copy after continuous use.

Accordingly, the current situation is that no toner and related technologies have yet been provided that realize both low-temperature fixing and heat resistance, is excellent in terms of offset resistance, enables control of the toner structure, and has good charging ability and suitability for cleaner-less apparatus without soiling of the developing device and the like, and that it is desired that they be desired to be provided as early as possible.

BRIEF SUMMARY

In an aspect of this disclosure, there is provided a toner which realizes both low-temperature fixing and heat resistance, is excellent in terms of offset resistance, enables control of the toner structure, and has good charging ability and suitability for cleaner-less apparatus without soiling of the developing apparatus or the like, as well as a developer, toner container, process cartridge, image forming apparatus and image forming method that use this toner.

Various other aspects may be provided, such as, for example, any one or more of the following:

<1> A toner including a binder resin, a colorant, a releasing agent and zeolite, wherein the toner is manufactured through O/W type wet granulation and has an average circularity of 0.970 or greater.

<2> The toner according to <1>, wherein the toner comprises a negative charge.

<3> The toner according to <1>, wherein the cation exchange capacity (CEC) of the zeolite is 150 meq/100 g to 800 meq/100 g.

<4> The toner according to <3>, wherein the zeolite is a synthetic zeolite having a cation exchange capacity (CEC) of 400 meq/100 g to 600 meq/100 g.

<5> The toner according to any one of <1> to <4>, wherein the binder resin comprises polyester resin.

<6> The toner according to any one of <1> to <5>, wherein the oil phase used in the O/W type wet granulation comprises an organic solvent.

<7> The toner according to any one of <1> to <6>, wherein the toner is used in non-magnetic one-component developing.

<8> A method for producing a toner including adding zeolite; and producing a toner through O/W type wet granulation.

<9> A developer including the toner according to any one of <1> to <7>.

<10> A toner container including the toner according to any one of <1> to <7>.

<11> A process cartridge including a latent electrostatic image bearing member and a developing unit configured to form a visible image by developing a latent electrostatic image formed on a latent electrostatic image bearing member by using the toner according to any one of <1> to <7>.

<12> The process cartridge according to <11>, further including a re-charging unit configured to re-charge residual toner particles left on the latent electrostatic image bearing member after the transferring step by use of a re-charging member.

<13> An image forming apparatus including: a latent electrostatic image forming unit configured to form a latent electrostatic image on a latent electrostatic image bearing member; a developing unit configured to develop the latent electrostatic image using the toner according to any one of <1> to <7> to form a visible image; a transferring unit configured to transfer the visible image to a recording medium; and a fixing unit configured to fix the visible image to the recording medium.

<14> The image forming apparatus according to <13>, further including a re-charging unit configured to re-charge residual toner particles left on the latent electrostatic image bearing member after the transferring step by use of a re-charging member, wherein a cleaner-less system is employed in which the residual toner particles are recovered along with development of the latent electrostatic image formed on the latent electrostatic image bearing member.

<15> The image forming method according to <14>, wherein the re-charging member is a conductive sheet provided in such a manner as to be pressed against a surface of the latent electrostatic image bearing member.

<16> An image forming method including: forming a latent electrostatic image on a latent electrostatic image bearing member; developing the latent electrostatic image using a toner according to any one of <1> to <7> to form a visible image; transferring the visible image to a recording medium; and fixing the visible image to the recording medium.

<17> The image forming method according to <16>, further including re-charging residual toner particles left on the latent electrostatic image bearing member after the transferring step by use of a re-charging member, wherein a cleaner-less system is employed in which the residual toner particles are recovered along with development of the latent electrostatic image formed on the latent electrostatic image bearing member.

<18> The image forming method according to <17>, wherein the re-charging member is a conductive sheet provided in such a manner as to be pressed against a surface of the latent electrostatic image bearing member.

The aforementioned toner contains at least a binder resin, a colorant, a releasing agent and zeolite, is manufactured O/W type wet granulation, and has an average circularity of 0.970 or greater.

Because the toner contains zeolite, which has high cation exchange capacity, and is made through the O/W type wet granulation, the toner maintains adequate charging ability in the course of developing, causes little image degradation due to soiling as a result of over long time use, realizes both low-temperature fixing and heat resistance, and has excellent offset resistance. In addition, zeolite can prevent deformation of toner particles because zeolite imparts little structural viscosity in the oil drops. As a result, it is possible to obtain a highly charged spherical toner with an average circularity of 0.970 or higher.

The aforementioned developer contains the aforementioned toner. As a result, when image formation is accomplished through an electronic photography method using the developer, both low-temperature fixing and heat resistance can be realized, excellent offset resistance results and high-quality images can be obtained.

The aforementioned toner container contains the aforementioned toner. As a result, when image formation is accomplished through an electronic photography method using the toner contained in the toner container, both low-temperature fixing and heat resistance can be realized, excellent offset resistance results and high-quality images can be formed.

The aforementioned process cartridge includes at least a latent electrostatic image bearing member and a developing unit configured to form a visible image by developing a latent electrostatic image formed on the latent electrostatic image bearing member by using the aforementioned toner. This process cartridge can be detachably mounted to the image forming apparatus, is easy to handle, and uses the aforementioned toner. Thus, both low-temperature fixing and heat resistance can be realized, excellent offset resistance results and high-quality images can be obtained.

The aforementioned image forming apparatus includes at least a latent electrostatic image bearing member, a latent electrostatic image forming unit, a developing unit, a transfer unit and a fixing unit. In the image forming apparatus, the latent electrostatic image forming unit forms a latent electrostatic image on the latent electrostatic image bearing member. The developing unit forms a visible image by developing the latent electrostatic image by using the aforementioned toner. The transfer unit transfers the visible image onto a recording medium. The fixing unit fixes the visible image transferred to the recording medium. As a result, both low-temperature fixing and heat resistance can be realized, excellent offset resistance results and high-quality electronic photography images can be formed.

The aforementioned image forming method includes at least a latent electrostatic image forming step, a developing step, a transfer step and a fixing step. In the latent electrostatic image forming step of the image forming method, a latent electrostatic image is formed on the latent electrostatic image bearing member. In the developing step, a visible image is formed by developing the latent electrostatic image by using the aforementioned toner, and in the transfer step, the visible image is transferred to a recording medium. In the fixing process, the visible image transferred to the recording medium is fixed thereto. As a result, both low-temperature fixing and heat resistance can be realized, excellent offset resistance results and high-quality electronic photography images can be formed.

DETAILED DESCRIPTION OF THE INVENTION (Toner)

Figure 1:
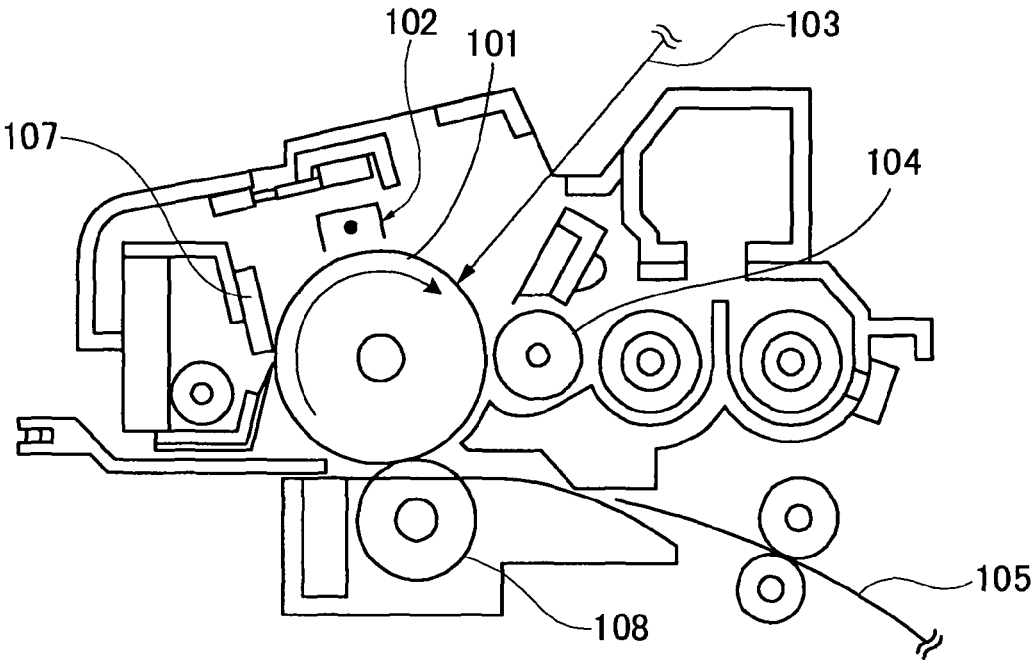
FIG. 1 is a schematic view showing an example of the process cartridge used in the present invention.

The toner of the present invention contains at least a binder resin, a colorant, a releasing agent and zeolite, and furthermore, contains as necessary a charge control agent, an external additive, a cleaning agent and other ingredient(s), and is manufactured O/W type wet granulation.

(Average Circularity)

The average circularity of the above-described toner is 0.970 or higher and is preferably 0.975 or higher. When the average circularity is less than 0.970, the charge distribution becomes broad and transferability becomes poor.

The average circularity can be found by dividing the circumference of a circle with the same area as a projected area of a particle image, which has been optically detected and analyzed using a CCD camera after causing a toner-containing suspension to pass through an image pick-up detection band on a flat plate, by the circumference of the actual particle.

More specifically, it is possible to obtain average circularity as follows: To 100 mL to 150 mL of solid impurities-free water in a container is added 0.1 mL to 0.5 mL of surfactant, preferably alkyl benzene sulfonate as a dispersing agent, and 0.1 g to 0.5 g of sample. Thereafter dispersion treatment is effected for 1-3 minutes using an ultrasonic disperser in the suspension in which the sample is dispersed, with a dispersion concentration of 3000 to 10,000 units/mL. The resultant sample solution is then analyzed on a flow-type particle image analyzer FPiA-2000, SYSMEX CORPORATION) to measure toner shape and distribution.

(Particle Diameter)

For the toner particle diameter, volume-average particle diameter (Dv) is preferably 4 μm to 12 μm, and more preferably 4 μm to 10 μm. The ratio of volume-average particle diameter (Dv) to number-average particle diameter (Dp) is preferably 1.30 or less, and more preferably 1.20 or less.

The particle size distribution of the toner can be measured by the COULTER COUNTER method, for example. As the measuring apparatus using the COULTER COUNTER method, the COULTER COUNTER TA-II or COULTER MULTISIZER II (both manufactured by BECKMAN COULTER, INC.) may be cited as examples. The specific measurement method is discussed below.

First, 0.1 mL to 5 mL of a surfactant (preferably, alkyl benzene sulfonate) is added as a dispersing agent to 100 mL to 150 mL of an electrolyte solution. As the electrolyte, a 1% by mass NaCl solution is prepared using grade-A sodium chloride, and for example ISOTON-II (made by BECKMAN COULTER, INC.) can be used.

Furthermore, the measurement sample is made solid and 2 mg to 20 mg of this is added. The electrolyte in which the sample is suspended undergoes around 1-3 minute-dispersion processing with an ultrasonic disperser, and the toner particles or toner volume and count are measured by the aforementioned measurement apparatus using an aperture of 100 μm, and the volume distribution and particle distribution are calculated. From the distributions obtained, the volume-average particle diameter (Dv) and number-average particle diameter (Dp) of the toner can be found.

Thirteen channels are used—2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm. Particles with a diameter of 2.00 μm or greater and less than 40.30 μm can be targeted.

<Zeolites>

Zeolite is a mineral belonging to the zeolite group. In addition to naturally occurring zeolites, there are also synthetic zeolites, which are chemically prepared and manufactured from refined chemicals, and artificial zeolites, which are obtained through alkaline processing of coal ash for crystallization into zeolite. Discussions of artificial zeolites are posted for example on the home page of the Zeolite Forum (http://www.zeolite-fcom/info03.html) and the home page of the Japan Environmental Sanitation Center (http://www.jesc.or.jp/report/sympo05_report/pdf/209.pdf).

In terms of its chemical composition, zeolite is an alkaline metal salt or alkaline earth metal salt of alumino-silicate and is primarily composed of silicon and alumina. It has a special crystal structure having a countless number of small holes and spaces. In this crystal structure, the position of the silicon is electrically neutral, while in comparison the position of the aluminum exists in a state with a negative electric charge, so that sodium ions and other cations are attracted by this. Accordingly, when this is contained in toner, it is possible to endow the toner with high charging ability through this negative electric charge of the aluminum position.

The zeolite has the objective of obtaining suitable charging ability performance, and artificial zeolite or synthetic zeolite having a cation exchange capacity (CEC), which is an indication of the negative charging ability, of 150 meq/100 g to 800 meq/100 g is preferable, and more preferably, synthetic zeolite having a CEC of 400 meq/100 g to 600 meq/100 g. When the CEC is less than 150 meq/100 g, adequate charging ability performance cannot be obtained, while when this is larger than 800 meq/100 g, synthesis of artificial zeolite or synthetic zeolite is difficult.

CEC is the capacity of a fixed quantity of a material to absorb cations in the form of exchange with other cations on the surface of that material, and normally at a pH of 7.0, is considered the aggregate amount of negative charges the material has. This is also known as the base replacement capacity. In general, this is expressed in an amount equivalent to milligrams per 100 g of the material (meq/100 g), but in SI units it is expressed as (cmol(+)$kg^{-1}$).

CEC is extracted using, for example, the Scholenberger method, and can be measured using a soil and crop comprehensive analysis system (manufactured by Fujihira Industry Co. Ltd.)

Regarding the amount of zeolite contained in the toner, 0.1 parts by mass to 5.0 parts by mass with respect to 100 parts by mass of the toner is preferable, and more preferably 0.2 parts by mass to 3.0 parts by mass, and still more preferably 0.2 part by mass to 2.5 parts by mass. When the zeolite content is less than 0.1 parts by mass, the efficacy of the present invention is not exhibited, and when the content exceeds 5 parts by mass, the dispersion of the zeolite in the toner worsens, the electric charge distribution becomes broad and soiling and toner spills occur.

There are no particular restrictions on the binder resin, but polyester resin is preferable from the perspective of easily realizing both low-temperature fixing and heat resistance. In addition, modified polyester resin may also be used as necessary.

-Polyester Resins-

There are no particular restrictions on the polyester resins, which can be appropriately selected in accordance with objective, and for example polycondensates of the polyols and carboxylic acids below can be cited. The polyester resins may be used singly or in combination.

-Polyols-

There are no particular restrictions on the polyols, but for example alkylene glycols, alkylene ether glycols, alicyclic diols, bisphenols, alkylene oxide additives of the alicyclic diols, alkylene oxide additives of the bisphenols, trivalent or higher multivalent aliphatic alcohols, trivalent or higher phenols or alkylene oxide additives of the trivalent or higher polyphenols can be cited. These may be used singly or in combination.

As the alkylene glycols, examples include ethylene glycol, 1,2-propylene glycol, 1,3-propylene glycol, 1,4-butan diol and 1,6-hexane diol.

As the alkylene ether glycols, examples include diethylene glycol, triethylene glycol, dipropylene glycol, polyethylene glycol, polypropylene glycol or polytetramethylene ether glycol.

As the alicyclic diols, examples include 1,4-cyclohexane dimethanol or hydrogenated bisphenol A.

As the bisphenols, examples include 4,4-dihydroxy biphenyls, bis (hydroxyphenyl) alkanes or bis(4-hydroxyphenyl) ethers.

As the 4-4'-dihydroxy biphenyls, examples include bisphenol A, bisphenol F, bisphenol S or 3,3'-difluoro-4,4'dihydroxy phenyl.

As the bis(hydroxyphenyl) alkanes, examples include: bis (3-fluoro-4-hydroxyphenyl) methane, 1-phenyl-1,1-bis(3-fluoro-4-hydroxyphenyl)ethane, 2-2-bis(3-fluoro-4-hydroxyphenyl) propane, 2,2-bis(3,5-difluoro-4-hydroxyphenyl) propane (also known as tetrafluoro bisphenol A) or 2,2-bis(3-hydroxyphenyl)-1,1,1,3,3,3-hexafluoro propane.

As the bis(4-hydroxyphenyl)ethers, examples include bis (3-fluoro-4-hydroxyphenyl)ether and the like.

As alkylene oxide additives of alicyclic diols, examples that can be cited include ethylene oxide additives, propylene oxide additives or butylenes oxide additives.

As the alkylene oxide additives of bisphenols, examples include ethylene oxide additives, propylene oxide additives or butylene oxide additives.

As the trivalent or higher multivalent aliphatic alcohols, examples include glycerin, trimethylol ethane, trimethylol propane, pentaerythritol or sorbitol.

As the trivalent or higher phenols, examples include trisphenol PA, phenol novolac or cresol novolac.

Of these, alkylene glycols having 2-12 carbon atoms or alkylene oxide additives of bisphenol are preferable, and it is preferable to use alkylene oxide additives of bisphenol together with alkylene glycols having 2-12 carbon atoms.

--Polycarboxylic Acids--

As polycarboxylic acids, examples include alkylene dicarboxylic acids, alkenylene dicarboxylic acids or aromatic dicarboxylic acids. These may be used alone, or two or more may be used together.

As the alkylene dicarboxylic acids, examples include succinic acid, adipic acid or sebacic acid. As the alkenylene dicarboxylic acids, examples include maleic acid or fumaric acid.

As the aromatic dicarboxylic acids, examples include phthalic acid, isophthalic acid, terephthalic acid, naphthalene dicarboxylic acid, 3-fluoro isophthalic acid, 2-fluoro isophthalic acid, 2-fluoro terephthalic acid, 2,4,5,6-tetrafluoro isophthalic acid, 2,3,5,6-tetrafluoro terephthalic acid, 5-trifluoro methyl isophthalic acid, 2,2-bis(4-carboxy phenyl) hexafluoro propane, 2,2-bis(4-carboxy phenyl) hexafluoro propane, 2,2-bis(3-carboxy phenyl) hexafluoro propane, 2,2'-bis (trifluoro methyl)-4-4'-biphenyl carboxylic acid, 3-3'-bis (trifluoro methyl)-4-4'-biphenyl carboxylic acid, 2,2'-bis(trifluoro methyl)-3,3'-biphenyl carboxylic acid or hexafluoro isopropylidene diphthalic acid anhydride.

In addition, as the trivalent or higher polycarboxylic acids, aromatic polycarboxylic acids having 9-20 carbon atoms, such as trimellitic acid or pyromellitic acid, can be cited. In addition, the acid anhydrides or low-grade alkyl esters of the above-described compounds may be reacted with polyols. As the polyols reacted with at this time, examples include methyl esters, ethyl esters and isopropyl esters.

Of these, alkenylene dicarboxylic acids having 4-20 carbon atoms or aromatic dicarboxylic acids having 8-20 carbon atoms are preferable.

For the proportions of the polyol and polycarboxylic acid, in terms of the equivalence ratio [OH]/[COOH] of hydroxyl groups [OH] to carboxyl groups [COOH], generally the ratio is 2/1 to 1/1/, preferably 1.5/1 to 1/1, and more preferably 1.3/1 to 1.02/1.

The molecular weight of the polyester, at peak molecular weight, is typically 1,000 to 30,000, and is preferably 1,500 to 10,000 and is more preferably 2,000 to 8,000. When this peak molecular weight is less than 1,000, the heat-resistant self-preservation property worsens, and when this exceeds 30,000, the low-temperature fixing property worsens.

--Modified Polyester Resins--

The binder resins used in the present invention have their viscosity and elasticity prepared with the objective of presenting offsets, and these may contain modified polyester resins having at least one out of urethane groups or urea groups.

The modified polyester resin content is preferably 20% by mass or less in the above-described binder resin, and more preferably 15% by mass or less, and particularly preferably 10% by mass or less. When this content is greater than 20% by mass, the low-temperature fixing property worsens.

The modified polyester resins may be mixed directly into the binder resin, but from the perspective of productivity, it is preferable for a prepolymer of relatively low molecular weight having at its end an isocyanate group, and an amine that reacts with this, to be mixed into the binder resin and a chain extending or crosslinking reaction to be accomplished during or after granulation to make the modified polyester resin. Through this, it is easy for the modified polyester resin of relatively high molecular weight to be contained in the core to regulate viscosity and elasticity.

--Prepolymer--

As the prepolymer, a polycondensate of the above-described polyols and polycarboxylic acid which causes polyisocyanate to further react with polyester having an active hydroxyl group can be cited.

As the activated hydroxyl group, examples that can be cited include: hydroxyl groups (alcohol hydroxyl groups and phenolic hydroxyl groups), amino groups, carboxyl groups or mercapto groups, and of these, alcohol hydroxyl groups are preferable.

--Polyisocyanate--

As the polyisocyanates, examples include aliphatic polyisocyanates, alicyclic polyisocyanates, aromatic diisocyanates, aromatic aliphatic diisocyanates, isocyanurates or polyisocyanates blocked by a phenol derivative, oxime or caprolactam. These may be used alone, or two or more may be used together.

As the aliphatic polyisocyanates, examples that can be cited include tetramethylene diisocyanate, hexamethylene diisocyanate and 2,6-diisocyanate methyl caproate.

As the alicyclic polyisocyanates, examples include isophorone diisocyanate and cyclohexyl methane diisocyanate.

As the aromatic polyisocyanates, examples include tolylene diisocyanate and diphenyl methane diisocyanate.

As the aromatic aliphatic diisocyanates, examples include α,α,α',α'-tetramethyl xylene diisocyanate.

For polyisocyanate, with the ratio by mass [NCO]/[OH] of the isocyanate group [NCO] to the hydroxyl group [OH] of polyester having a hydroxyl group, the ratio 5/1 to 1/1 is preferable, and more preferably 4/1 to 1.2/1, and still more preferably 2.5/1 to 1.5/1. When the [NCO]/[OH] ratio exceeds 5, the low-temperature fixing property worsens, while when the [NCO]/[OH] ratio is less than 1, the urea content in the modified polyester resin becomes low and offset resistance worsens.

The polyisocyanate component content of the prepolymer is preferably 0.5% by mass to 40% by mass, and more preferably 1% by mass to 30% by mass, and still more preferably 2% by mass to 20% by mass. When this content is less than 0.5% by mass, the offset resistance worsens, and when this exceeds 40% by mass, the low-temperature fixing property worsens.

The number of isocyanate groups per molecule in the prepolymer is normally one or greater, and is preferably 1.5 to 3 on average, and more preferably 1.8 to 2.5 on average. When the number of isocyanate groups is less than 1, the molecular weight of the modified polyester resin after the chain extending or crosslinking reactions becomes low, reducing offset resistance.

--Chain Extending/Crosslinking Agent--

In the present invention, it is possible to use amines as chain extending/crosslinking agents. As these amines, diamine, trivalent or higher polyamines, amino alcohol, amino mercaptans, amino acids, or any of these with blocked amino groups can be cited.

As these diamines, aromatic diamines, alicyclic diamines and aromatic diamines can be cited.

As the aromatic diamines, examples include phenylene diamine, diethyl toluene diamine, 4,4'-diaminophenyl methane, tetrafluoro-p-xylylene diamine and terafluoro-p-phenylene diamine.

As the alicyclic diamines, examples include 4,4'-diamino-3,3'-dimethyl dicyclohexyl methane, diamine cyclohexane and isophorone diamine.

As the aliphatic diamines, examples include ethylene diamine, tetramethylene diamine, hexamethylene diamine, dodecafluorohexylyene diamine and tetracosafluoro dodecylene diamine.

As the trivalent or higher polyamines, examples include diethylene triamine and triethylene tetramine.

As the amino alcohols, examples that can be cited include ethanol amine or hydroxyethyl aniline.

As the amino mercaptans, examples that can be cited include amino ethyl mercaptan or amino propyl mercaptan.

As the amino acids, examples include amino propionic acid and amino capronic acid.

As the substances with blocked amino groups, oxazoline compounds or ketimine compounds obtained from amines and ketones can be cited. As the ketones, examples include acetone, methyl ethyl ketone and methyl isobutyl ketone.

--Termination Agents--

In the chain extending or crosslinking reaction, the molecular weight of the modified polyester resin after the completion of the reaction may be adjusted further using a termination agent, as necessary.

As the termination agent, examples include monoamines (diethyl amine, dibutyl amine, butyl amine, lauric amine and the like), and blocked compounds thereof (ketimine compounds).

The proportion of these amines is preferably such that the ratio by mass [NCO]/[NHx] of the isocyanate group [NCO] in the prepolymer to the amino group in the amine [NHx] is 1/2 to 2/1, and more preferably 1.5/1 to 1/1.5, and still more preferably 1.2/1 to 1/1.2. When the [NCO]/[NHx] is larger than 2, or is less than ½, the molecular weight of the modified polyester resin becomes low, and the hot offset resistances worsens.

--Colorants--

There are no particular restrictions on the colorant, and the colorant can be appropriately selected from among the commonly known dyes and pigments, for example: carbon black, nigrosin pigment, iron black, naphthol yellow S, Hansa yellow (10G, 5G, G), cadmium yellow, yellow iron oxide, yellow ochre, chrome yellow, titanium yellow, polyazo yellow, oil yellow, Hansa yellow (GR, A, R, N, R), pigment yellow L, benzidine yellow (G, GR), permanent yellow 9NCG), vulcan fast yellow (5G, R), tartrazine lake, quinoline yellow lake, antrazan yellow BGL, isoindolinone yellow, red ocher, minimum, vermilion lead, cadmium red, cadmium mercury red, antimony vermilion, permanent red 4R, para red, false (?) red, p-chloro o-nitroaniline red, lithol fast Scarlet G, brilliant fast scarlet, brilliant carmine BS, permanent red (F2 R and F4 R, FRL, FRLL, F4RH), fast scarlet VD, vulcan fast rubine B, brilliant scarlet G, lithol rubine GX, permanent red F5R, brilliant carmin 6B, pigment scarlet 3B, Bordeaux 5B, toluidine maroon, and permanent Bordeaux F2K, helio Bordeaux BL, Bordeaux 10B, a BON maroon light, a BON maroon medium, eosine lake, rhodamine lake B, rhodamine lake Y, alizarin lake, thioindigo red B, thioindigo maroon, oil red, quinacridone red, pyrazolone red, polyazo red, chromium vermilion, benzidine orange, perynone orange, oil orange, cobalt blue, cerulean blue, alkali blue lake, peacock blue lake, Victoria blue lake, non-metal phthalocyanine blue, phthalocyanine blue, fast sky blue, indanthrene blue (RS, BC), indigo, ultramarine blue, navy blue, anthraquinone blue, fast violet B, methyl violet lake, cobalt violet, manganese violet, dioxane violet, anthraquinone violet, chrome green, zinc green, chrome oxide, viridian, emerald green, pigment green B, naphthol green B, green gold, acid green lake, Malachite green lake, phthalocyanine green, anthraquinone green, titanium oxide, zinc white or lithopone. These colorants may be used singly or in combination.

The amount of colorant contained in the toner is not particularly restricted and may be set to an appropriate level in accordance with the purpose, but it is preferably contained in an amount of 1% by mass to 15% by mass, and even more preferably, 3% by mass to 10% by mass.

When this content is less than 1% by mass, a decline in the toner coloring power is seen, and when this exceeds 15% by mass, it results in poor dispersion of the pigment in the toner. Thus coloring power decreases and the electrical properties of the toner may also become poor.

This colorant may also be used as a master batch combined with resin. For this resin, there are no particular restrictions and the resin can be appropriately selected from among those known in the art in accordance with the purpose, and examples include polymers of styrene or substitutes thereof, styrene copolymers, polymethyl methacrylate, polybutyl methacrylate, polyvinyl chloride, polyethylene, polypropylene, polyester, epoxy resin, epoxy polyol resin, polyurethane, polyamide, polyvinyl butyral, polyacrylate resin, rosin, modified rosin, terpene resin, aliphatic hydrocarbon resin, alicyclic hydrocarbon resin, aromatic petroleum resin, paraffin chloride or paraffin. These may be used singly or in combination.

As the polymers of styrene or substitutes thereof examples include polyester resin, polystyrene, poly-p-chlorostyrene and polyvinyl toluene. As the styrene copolymers, examples include styrene-p-chlorostyrene copolymer, styrene-propylene copolymer, styrene vinyl toluene copolymer, styrene vinyl naphthalin copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl acrylate copolymer, styrene-α-chloromethacrylate methyl copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer.

The master batch can be produced by mixing or kneading together the master batch resin and the colorant while applying a high shear force. In order to promote interaction between the colorant and resin, it is preferable to add an organic solvent. In addition, the so-called flashing method can use wet cakes of colorant as it is, and this is suitable because drying is not necessary. This flashing method is a method that mixes or kneads a water-based paste containing colorant water with the resin and organic solvent, causes the colorant to migrate to the resin side and then removes the moisture and organic solvent component. For the mixing or kneading, a high shear force dispersion apparatus such as a three-roller mill, for example, may be appropriately used.

<Releasing Agents>

There are no particular restrictions on the releasing agents, which may be appropriately selected from among those that are commonly known in the art in accordance with the purpose, and for example waxes and the like can be suitably cited.

As the waxes, examples include waxes containing a carbonyl group, polyolefin waxes or long-chain hydrocarbons. These may be used singly or in combination. Among these, carbonyl group-containing waxes are preferable.

As the carbonyl group-containing waxes, examples include polyalkanate esters, polyalkanol esters, polyalkanic acid amides, polyalkyl amides or dialkyl ketones. As the polyalkanate esters, examples that can be cited include carnauba wax, montan wax, trimethylolpropane tribehenate, pentaerythritol tetrabehenate, pentaerythritol diacetate dibehenate, glycerin behenate or 1,18-octadecanediol distearate. As the polyalkanol esters, examples that can be cited include tristearyl trimellitate and distearyl maleate. As the polyalkanic acid amides, examples that can be cited include dibehenyl amide. As the polyalkyl amides, examples that can be cited include tristearylamide trimellitate. As the dialkyl ketones, examples that can be cited include distearyl ketone. Among these carbonyl group-containing waxes, polyalkanate esters are particularly preferable.

As the polyolefin waxes, examples include polyethylene wax and polypropylene wax.

As the long chain hydrocarbons, examples include paraffin wax and sazole wax.

The releasing agent content is preferably 5% by mass to 15% by mass with respect to all the toner ingredients. When the content is less than 5%, the separation effect disappears and latitude for offset prevention may disappear. On the other hand, when the content exceeds 15%, because the releasing agent melts at low temperatures, the releasing agent is readily susceptible to the effects of thermal energy and mechanical energy, and when agitated in the developing section, the wax seeps out of the toner, adheres to the toner regulating member and photoconductor and causes smears on an image.

The heat-absorbing peak (melting point) of the releasing agent upon heating, as measured by a differential scanning calorimeter (DSC), is preferably 65° C. to 115° C. from the perspective of making low-temperature fixing of the toner easy. When the melting point is less than 65° C., the fluidity worsens, and when the melting point is higher than 115° C., fixing properties worsen.

<Charge Control Agent>

There are no particular restrictions on the charge control agent, which can be appropriately selected from among those commonly known in the art in accordance with the purpose, and examples include nigrosin dye, triphenyl methane dye, metal complex dye containing chrome, molybdate chelate pigment, rhodamine dye, alkoxy amines, quaternary ammonium salts (including modified fluorine quaternary ammonium salts), alkyl amides, phosphorus alone or in compounds, tungsten alone or in compounds, fluorine activators, metal salts of salicylic acid and metal salts of salicylic acid derivatives.

Commercially available charge control agents may be employed, and examples include: the nigrosin dye Bontron 03, the quaternary ammonium salt BONTRON P-51, the azo pigment containing metal BONTRON S-34, the oxynaphthoeic acid metal complex E-82, the salicylic acid type metal complex E-84, the phenol type condensate E-89 (the above all manufactured by ORIENT CHEMICAL INDUSTRIES CO., LTD.), the quaternary ammonium salt molybden complexes TP-302 and TP-415 (the above both manufactured by HODOGAYA CHEMICAL CO., LTD.), the quaternary ammonium salt COPY CHARGE PSY VP2038, the triphenyl methane derivative COPY BLUE PR, the quaternary ammonium salts COPY CHARGE NEG VP2036 and COPY CHARGE NX VP434 (the above manufactured by HOECHST), LRA-901 and the boron complex LR-147

(manufactured by JAPAN CARLIT CO., LTD.), copper phthalocyanine, perylene, quinacridone, azo type pigments and other compounds of polymer types having functional groups such as sulfonate groups, carboxyl groups or quaternary ammonium salts.

The charge control agent may be dissolved or dispersed after being fused and kneaded with the master batch, or this agent may be added directly to the organic solvent along with the various toner ingredients when dissolved o dispersed or may be fixed to the toner surface after the toner particles are produced.

<External Additives>

--Inorganic Fine Particles--

Inorganic fine particles may be preferably used as an external additive in order to supplement the fluidity, developing properties and charging ability of the color toner particles obtained with the present invention.

As the inorganic fine particles, examples that can be cited include: silica, alumina, titanium oxide, barium titanate, magnesium titanate, calcium titanate, strontium titanate, zinc oxide, tin oxide, silica sand, clay, mica, Wollastonite, diatom earth, chrome oxide, cerium oxide, iron red, antimony trioxide, magnesium oxide, compound oxides such as silicon oxide/magnesium oxide or silicon oxide/aluminum oxide, zirconium oxide, barium sulfate, barium carbonate, calcium carbonate, silicon carbide or silicon nitride.

The primary particle diameter of the inorganic fine particles is preferably 5 nm to 2 μm, and more preferably 5 nm to 50 nm. In addition, the relative surface area of the inorganic fine particles as measured by the BET method is preferably 20 $m^2/g$ to 500 $m^2/g$.

The inorganic fine particle content in the toner is not particularly restricted, and for example 0.01% by mass to 5% by mass is preferable, and more preferably 0.01% by mass to 2.0% by mass.

--High Polymer Fine Particles--

As the external additives, besides inorganic fine particles as high polymer fine particles, examples include copolymers of polystyrene, methacrylate esters and acrylate esters obtained by soap-free emulsion polymerization, suspension polymerization and dispersion polymerization, as well as polymer particles obtained from polycondensation products and thermosetting resins such as silicone, benzoguanamine, nylon and the like --Surface Treatment Agents--

The external additives can increase hydrophobicity when used for surface treatment, preventing deterioration of fluid properties and charging properties even under high humidity.

As surface treatment agents that can accomplish this kind of surface treatment, examples include silane coupling agents, silicizing agents, silane coupling agents having alkyl fluoride groups, organic titanate coupling agents, aluminum coupling agents, silicone oil or modified silicone oil.

--Cleaning Agents--

In the toner of the present invention, a cleaning supplement can be used in order to remove post-transfer developer that is residual on the photoconductor and the primary transfer medium. As this cleaning supplement, examples that can be cited include polymer fine particles created through soap-free emulsion polymerization of fatty acid metal salts, polymethyl methacrylate fine particles, polystyrene fine particles or the like. As the fatty acid metal salts, examples that can be cited include zinc stearate, calcium stearate or stearic acid.

The polymer fine particles preferably have a relatively narrow particle size distribution and a volume-average particle size of 0.01 μm to 1 μm.

(Toner Manufacturing Method)

The toner of the present invention is produced by O/W type wet granulation after adding zeolite. This O/W type wet granulation specifically includes at least a granulation step wherein toner components such as binder resin, colorant, releasing agents and the like are dissolved or dispersed in an organic solvent in the oil phase and after that the dissolved or dispersed material is dispersed in a water-based medium to create particles, and preferably contains a chain extending crosslinking reaction step, cleaning and drying step, external treatment step and the like as appropriately necessary.

<Granulation Procedure>

--Organic Solvent--

There are no particular restrictions on the organic solvent, and for example those with a Hansen dissolution parameter of 19.5 or less as noted in the Polymer Handbook, $4^{th}$ Edition by Wile-Interscience, Volume 2, Section VII, can be cited, and of these, those that are volatile with a boiling point less than 100° C. are preferable because later solvent removal is easy.

As this kind of organic solvent, examples include toluene, xylene, benzene, carbon tetrachloride, methylene chloride, 1,2-dichloro ethane, 1,1,2-trichloro ethane, trichloro ethylene, chloroform, monochloro benzene, dichloroethylidene, methyl acetate, ethyl acetate, methyl ethyl ketone and methyl isobutyl ketone. These may be used singly or in combination.

Preferable among these organic solvents are ester-based solvents such as methyl acetate or ethyl acetate; aromatic solvents such as toluene or xylene; or hydrocarbon halides such as methylene chloride, 1,2-dichloro ethane, chloroform or carbon tetrachloride.

The polyester resin, colorants and releasing agents may be dissolved or dispersed simultaneously, but normally these are each dissolved or dispersed independently. The organic solvents used at this time may each be different or may be the same, and having the same solvent is preferable in consideration of subsequent solvent treatment.

--Dissolution or Dispersion of Binder Resin--

For the liquid that dissolves or disperses the binder resin, a resin concentration of 40% by mass to around 80% by mass is preferable. When this concentration exceeds 80% by mass, dissolution or dispersion is difficult and viscosity is also high, making handling difficult. In addition, when this concentration is less than 40% by mass, the volume of toner produced becomes small.

When modified polyester resin having an isocyanate group at its end is mixed into the binder resin, this may be mixed into the same solution for dissolving or dispersing or separate solutions for dissolving or dispersing may be produced, but it is preferable to produce solutions for dissolving or dispersing separately out of consideration of the dissolution and viscosity of each.

--Dissolution or Dispersion of Colorants--

The colorants may be dissolved or dispersed independently or may be mixed in to the solutions for dissolving or dispersing the polyester resin. In addition, dispersion supplements or polyester resin may be added as necessary, and the master batch may be used.

--Dissolution or Dispersion of Releasing Agent--

When wax is dissolved or dispersed as the releasing agent in cases where an organic solvent that does not dissolve wax is used, it results in use of a dispersion liquid. This dispersion liquid is produced through a general method. That is to say, the organic solvent and the wax may be mixed and dispersed with a dispersion machine like a beads mill.

In addition, dispersion time may be short with the following approach: After the organic solvent and wax have been mixed, the mixture is heated once to the melting point of the wax and then cooled with agitation, followed by dispersion with a dispersion machine such as a beads mill. For the wax, a plurality of types may be mixed together and used, and dispersion supplements and polyester resin may also be added.

--Aqueous Medium--

As the aqueous medium, water alone may be used but it is possible to also use a solvent that is mixable with water. Furthermore, an organic solvent whose Hansen dissolution parameter as discussed above is 19.5 or less may be mixed in, and an amount added to close to the saturation volume with respect to water is preferable from the perspective of increasing emulsification in the oil phase or dispersion stability.

As this solvent that is mixable with water, examples include alcohols (methanol, isopropanol, ethylene glycol and the like), dimethylformamide, tetrahydrofuran, cellosolve (methyl cellosolve and the like), or low-grade ketones (acetone, methyl ethyl ketone and the like).

The amount of aqueous medium used is preferably 50 parts by mass to 2,000 parts by mass with respect to 100 parts by mass of the toner composition, and more preferably 100 parts by mass to 1,000 parts by mass. When the amount used is less than 50 parts by mass, the dispersion status of the toner composition worsens and toner particles with a predetermined particle diameter cannot be obtained. In addition, it is not economical to have the amount used exceed 2,000 parts by mass.

--Inorganic Dispersion Agents and Organic Resin Fine Particles--

When the dissolution product or dispersion product of the toner composition is dispersed in the aqueous medium, the inorganic dispersion agent or organic resin fine particles are dispersed in the aqueous medium in advance, which is preferable because the particle size distribution becomes sharp and the dispersion becomes stable.

As the inorganic dispersion agents, examples that can be cited include tricalcium phosphate, calcium carbonate, titanium oxide, colloidal silica or hydroxyapatite.

As the resin that forms the organic resin fine particles, there are no particular restrictions as long as this is a resin formed with an aqueous dispersion body, and the resin may be a thermoplastic resin or a thermosetting resin. Examples that can be cited include: vinyl-based resins, polyurethane resins, epoxy resins, polyester resins, polyamide resins, polyimide resins, silicon-based resins, phenol resins, melamine resins, urea resins, aniline resins, ionomer resins or polycarbonate resins. These resins may be used singly or in combination.

Among these resins, vinyl-based resins, polyurethane resins, epoxy resins, polyester resins or combinations thereof are preferable because it is easy to obtain an aqueous dispersion of fine spherical resin particles.

The method of making the resin into an aqueous dispersion liquid of organic resin fine particles is not particularly restricted, and for example methods listed in (a) through (g) below can be used.

(a) In the case of the polyaddition or polycondensation resins such as polyester resins, polyurethane resins, epoxy resins and the like, a method in which the precursor (monomer, oligomer or the like) or the solvent solution is dispersed in an aqueous medium in the presence of a suitable dispersion agent, followed by heating and/or addition of curing agent for curing to produce an aqueous dispersion of resin fine particles.

(b) In the case of polyaddition or polycondensation resins such as polyester resins, polyurethane resins, epoxy resins and the like, a method in which a suitable emulsifier is dissolved in the precursor (monomer, oligomer or the like) or the solvent solution, and after this water is added and phase-change emulsification is accomplished. The solvent solution may be a liquid or may be changed to a liquid state through heating.

(c) A method in which a resin manufactured in advance through a high polymerization reaction (which may be any of the polymerization reactions such as addition polymerization, open-ring polymerization, multiple addition polymerization, addition condensation, polycondensation or the like) is crushed using a fine pulverization machine such as a mechanical rotation type or a jet type, and next after resin fine particles are obtained through sorting, these are dispersed in water in the presence of a suitable dispersion agent.

(d) A method in which a resin solution made by dissolving in a solvent a resin manufactured in advance through a high polymerization reaction (which may be any of the polymerization reactions such as addition polymerization, open-ring polymerization, multiple addition polymerization, addition condensation, polycondensation or the like) is sprayed in a mist to obtain resin fine particles, and then these are dispersed in water in the presence of a suitable dispersion agent.

(e) A method in which a resin solution is prepared by dissolving in a solvent a resin manufactured in advance through a high polymerization reaction (which may be any of the polymerization reactions such as addition polymerization, open-ring polymerization, multiple addition polymerization, addition condensation, polycondensation or the like), and by adding a solvent to this or cooling the resin solution in which the solvent was heat dissolved in advance, the resin fine particles are separated, and next, after resin fine particles are obtained by removing the solvent, these are dispersed in water in the presence of a suitable dispersion agent.

(f) A method in which a resin solution made by dissolving in a solvent a resin manufactured in advance through a high polymerization reaction (which may be any of the polymerization reactions such as addition polymerization, open-ring polymerization, multiple addition polymerization, addition condensation, polycondensation or the like) is dispersed in an aqueous medium in the presence of a suitable dispersion agent, and the solvent is removed from this through heating or pressure reduction or the like.

(g) A method in which after a suitable emulsifier is dissolved in a resin solution made by dissolving in a solvent a resin manufactured in advance through a high polymerization reaction (which may be any of the polymerization reactions such as addition polymerization, open-ring polymerization, multiple addition polymerization, addition condensation, polycondensation or the like), water is added and phase-change emulsification is accomplished.

--Surfactants--

In order for the oil phase that contains the toner composition to be emulsified and dispersed in an aqueous medium, surfactants may be used as necessary.

As the surfactants, examples include anion surfactants, amine-type cation surfactants, quaternary ammonium salt-type cation surfactants and nonionic surfactants.

As the anion surfactants, alkyl benzene sulfonate salts, α-olefin sulfonate salts and ester phosphates can be cited.

As the amine-type cation surfactants, examples include alkyl amine salts, amino alcohol fatty acid derivatives, polyamine fatty acid derivatives and dual nature surfactant imidazoline.

As the quaternary ammonium salt-type cation surfactants, alkyl trimethyl ammonium salts, dialkyl dimethyl ammonium salts, alkyl dimethyl benzyl ammonium salts, pyridinium salts, alkyl isoquinolinium salts and benzethonium chloride can be cited.

As the nonionic surfactants, examples include fatty acid amide derivatives and polyvalent alcohol derivatives.

As the dual-nature surfactants, examples include alanine, dodecyl di-(amino ethyl)-glycine, di-(octyl amino ethyl)-glycine and N-alkyl-N,N-dimethyl ammonium betaine.

Among these surfactants, it is preferable to use surfactants having a fluoroalkyl group because effects of surfactant can be obtained with an extremely small quantity.

As the aniline surfactants having a fluoroalkyl group, examples include fluoroalkyl carboxylic acid having 2-10 carbon atoms, and the metal salts thereof; disodium perfluorooctane sulfonyl glutamate, 3-[ω-fluoroalkyl (C6-C11) oxy]-1-alkyl (C3-C4) sodium sulfonate, 3-[ω-fluoroalkanoyl (C6-C8)-N-ethyl amino]-1-propane sodium sulfonate, fluoroalkyl (C11-C20) carboxylic acid or the metal salts thereof perfluoroalkyl carboxylic acid (C7-C13), or the metal salts thereof, per-fluoroalkyl (C4-C12) sulfonate or the metal salts thereof, perfluorooctane sulfonate diethanol amine, N-propyl-N-(2-hydroxyethyl) perfluorooctane sulfone amide, perfluoroalkyl (C6-C10) sulfone amine propyl trimethyl ammonium salts, per fluoroalkyl (C6-C10)-N-10-N-ethyl sulfonyl glycine salts, mono perfluoroalkyl (C6-C16) or ethylene phosphate ester.

As the cation surfactants having a fluoroalkyl group, examples that can be cited include aliphatic class-1, class-2 or class-3 aminic acid having a fluoroalkyl group, aliphatic quaternary ammonium salts such as per-fluoroalkyl (C6-C10) sulfone amide propyl trimethyl ammonium salt, benzalkonium salt, benzethonium chloride, pyridinium salts and imidazolinium salts.

The numbers such as C6 in the list of the surfactants indicate the number of carbon atoms.

--Protective Colloids--

In addition, the dispersion fluid drops may be stabilized by a high polymer protective colloid. As the high polymer protective colloid, examples include acids, (meth)acrylic monomers containing hydroxyl groups, vinyl alcohols or ethers of vinyl alcohols, esters of compounds containing vinyl alcohols or carboxyl groups, amide compounds or methylol compounds of these, chlorides, homopolymers or copolymers of compounds that include a nitrogen atom or a heterocycle of nitrogen atom, polyoxyethylenes, celluloses and the like.

As the acids, examples include: acrylic acid, methacrylic acid, α-cyanoacrylic acid, α-cyanomethacrylic acid, itaconic acid, crotonic acid, fumaric acid, maleic acid and anhydrous maleic acid. As (meth)acrylic monomers containing hydroxyl groups, examples include B-hydroxy ethylacrylate, β-hydroxy methylacrylate, β-hydroxy propylacrylate, β-hydroxy propylmethacrylate, γ-hydroxy propylacrylate, γ-hydroxy propylmethacrylate, 3-chloro-2-hydroxy propylacrylate, 3-chloro-2-hydroxy propylmethacrylate, diethylene glycol monoacrylic ester, diethylene glycol monomethacrylic ester, glycerin monoacrylic ester, glycerin monomethacrylic ester, N-methylolacrylamide and N-methylolmethacrylamide. As vinyl alcohols or ethers of vinyl alcohols, examples include vinyl methyl ether, vinyl ethyl ether, and vinyl propyl ether. As esters of compounds containing vinyl alcohols and carboxyl groups, examples include vinyl acetate, vinyl propionate and vinyl butyrate. As amide compounds or their methylol compounds, examples include: acryl amide, methacryl amide, diacetone acryl amide acid, and their methylol compounds. As the chlorides, examples include chloride acrylate and chloride methacrylate. As homopolymers or copolymers of compounds that include a nitrogen atom or a heterocycle of nitrogen atom, examples include vinyl pyridine, vinyl pyrolidone, vinyl imidazole and ethylene imine. As polyoxyethylenes, examples include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester and polyoxyethylene nonylphenylester. As celluloses, examples include methyl cellulose, hydroxyethyl cellulose and hydroxypropyl cellulose.

In order to stabilize the dispersion liquid drops, a dispersion stabilizer can be used as necessary.

As the dispersion stabilizer, examples that can be cited include acids such as calcium chloride phosphate, or compounds dissolvable in alkalis.

When the dispersion stabilizer is used, it is possible to remove the calcium chloride phosphate from the fine particles through a method of rinsing with water after the calcium chloride phosphate has been dissolved by an acid such as hydrochloric acid or the like, or a method that breaks this down using enzymes.

In addition, when the dispersion stabilizer is used, it is possible for this to remain in the surface of the toner particles, but a water rinse and removal approach is preferable in terms of charging ability of the toner.

As the method of dispersion, there are no particular restrictions and commonly known equipment can be appropriately selected, such as those using slow-speed shearing, high-speed shearing, friction, high-pressure jet or ultrasonic waves, but in order to make the particle diameter of the dispersed body 2 μm to 20 μm, the high-speed shear method is preferable. When a high-speed shear method dispersion device is used, there are no particular restrictions on the revolutions per minute, but this is preferably 1,000 rpm to 30,000 rpm, and more preferably 5,000 rpm to 20,000 rpm. As the temperature during dispersion, under pressure 0° C. to 150° C. is preferable, and more preferably 20° C. to 80° C.

As the method for removing the organic solvent from the emulsified dispersed body that is obtained, there are no particular restrictions and a commonly known method can be used. For example, a method can be cited wherein the temperature of the system as a whole is gradually increased at normal pressure or under reduced pressure, and the organic solvent in the liquid drops is completely evaporated and removed.

<Chain Extending or Crosslinking Reaction Step>

The chain extending or crosslinking reaction step is a step for introducing modified polyester resin having at least either urethane or urea groups.

In the chain extending or crosslinking reaction step, when the modified polyester resin and an amine family that can react with this are added, the amine family may be added in the oil phase prior to dispersion of the toner composition in the water-based medium, or the amine family may be added to the water-based medium.

The time required for the chain extending or crosslinking reaction may be appropriately selected based on the isocyanate group structure in the polyester polymer and the reactivity with the added amine, but typically this is 1 minute to 40 hours, and preferably 1 hour to 24 hours. The temperature during the chain extending or crosslinking reaction is preferably 0° C. to 150° C., and more preferably 20° C. to 98° C.

The chain extending or crosslinking reaction may be accomplished prior to loading of fine particles such as the inorganic fine particles, or may simultaneously progress during loading of fine particles. In addition, this may also be accomplished after the fine particle loading has been completed. In addition, commonly known catalysts can be used in the chain extending or crosslinking reaction as necessary.

<Cleaning and Drying Step>

The cleaning and drying step is a step of cleaning and drying the toner particles that were dispersed in the water-based medium.

As the cleaning and drying step, there are no particular restrictions and a commonly known method is used. Specifically, a method can be cited wherein after solids and liquids have been separated by a centrifuge, filter press or the like, the toner cake obtained is again dispersed in ion exchange water at room temperature to around 40° C., the pH is adjusted using acid or alkali as necessary and then the solids and liquids are again separated, and by repeating this process numerous times, impurities and surfactants and the like are removed and the result is then dried by an air flow dryer, a circulating dryer, a reduce pressure dryer, a vibration flow dryer of the like and through this a toner powder is obtained. During this, the toner fine particle components may be removed using a centrifuge or the like, and the desired particle size distribution may be achieved by using a commonly known sorter after drying, as necessary.

<External Additive Treatment Step>

The external additive treatment step is a step of mixing the toner powder obtained after drying together with heterogeneous particles such as electric charge control fine particles, fluidity enhancer fine particles or the like, fixing and fusing this at the surface by applying a mechanical shock to the mixed powder, and preventing separation of the heterogeneous particles from the surface of the complex particles obtained.

As specific means for the external additive treatment process, a method can be cited, for example, in which an impact force is applied to the mixture with a blade rotating at high speed, and a method in which the mixture is put in a high-speed air flow, and the particles or combined particles accelerated therein are made to collide with a suitable collision plate.

As the apparatus used in external additive treatment, examples that can be cited include: an ANGMILL (manufactured by HOSOKAWA MICRON CORPORATION), an I-TYPE MILL (made by NIPPON PNEUMATIC MFG. CO., LTD.) modified to decrease pulverization air pressure, a HYBRIDIZATION SYSTEM (made by NARA MACHINERY CO., LTD.), a KRYPTORON SYSTEM (made by KAWASAKI HEAVY INDUSTRIES, LTD.)., or an automatic mortar.

(Developer)

The developer of the present invention contains at least the toner of the present invention, and contains other appropriately selected components, such as carrier and the like. This developer may be a one-component developer or may be a two-component developer.

In the case of a one-component developer using the toner of the present invention, even after toner has been spent or supplied, there is little fluctuation in toner particle size, there is no filming of the toner on the developing roller or adhesion of the toner to the blades and other members that serve to make the toner layer thinner, and even during long-term use of the developing device (agitation), good, stable developing properties and images can be obtained.

As the carrier, there are no particular restrictions and this may be appropriately selected in accordance with the purpose, but it is preferable to employ a carrier having a core and a resin layer covering the core.

As the materials of this core, there are no particular restrictions and these may be appropriate selected from among those that are commonly known, and for example 50 emu/g to 90 emu/g manganese-strontium (Mn—Sr) materials or manganese-magnesium (Mn—Mg) materials are preferable, and in terms of ensuring image concentration, highly magnetic materials such as iron powder (100 emu/g or higher) or magnetite (75 emu/g to 120 emu/g) are preferable. In addition, in terms of being beneficial to high image quality by weakening around the photoconductor where the toner is spiking, weakly magnetic materials such as copper-zinc (Cu—Zn) materials (30 emu/g to 80 emu/g) are preferable. These may be used singly or in combination.

For the particle diameter of the core, the average particle diameter (weight-average particle diameter ($D_{50}$) is preferably 10 μm to 200 μm, and more preferably 40 μm to 100 μm.

When the average particle diameter (weight-average particle diameter (($D_{50}$)) is less than 10 μm, fine particles occur abundantly in the distribution of carrier particles, the magnetism per particle decreases and causes carrier scattering. When this exceeds 200 μm, the relative surface area decreases, toner scattering occurs, and in full color having many solids, development performance worsens particularly in the solids.

As the material of the resin layer, there are no particular restrictions and this may be appropriately selected from among commonly known resins in accordance with the objective, but among examples that can be cited are amino resins, polyvinyl resins, polystyrene-base resins, halogenated olefin resins, polyester resins, polycarbonate resins, polyethylene resins, polyvinyl fluoride resins, polytrifluoroethylene resins, polyhexafluoropropylene resins, copolymer of vinylidene fluoride and acryl monomer, copolymer of vinylidene fluoride and vinyl fluoride; fluoroterpolymers such as terpolymer of tetrafluoroethylene, vinylidene fluoride, and non-fluorinated monomer; and silicone resins. These may be used singly or in combination.

As the amino resins, examples include urea-formaldehyde resin, melamine resins, benzoguanamine resins, urea resins, polyamide resin sand epoxy resins. As the polyvinyl resins, examples include acrylic resins, polymethyl methacrylate resins, polyacrylonitrile resins, polyvinyl acetate resins, polyvinyl alcohol resins, and polyvinyl butyral resins. As the polystyrene-base resins, examples include polystyrene resins and styrene-acryl copolymer resins. As the halogenated olefin resins, examples include polyvinyl chloride. As the polyester resins, examples include polyethylene terephthalate resins and polybutylene terephthalate resins.

As needed, a conductive powder or the like may be contained in the resin layer. As this conductive powder, examples that can be cited include metal powder, carbon black, titanium oxide, tin oxide, and zinc oxide. These conductive powders preferably have an average particle diameter of 1 μm or less. When the average particle diameter exceeds 1 μm, it is hard to control the electric resistance.

The resin layer can be formed for example by dissolving the silicone resin or the like in a solvent for preparation of coating solution, after which this coating solution is uniformly applied onto the surface of the core through a commonly known coating method, and baked on after dried. As the coating method, immersion coating, spray coating, and brush coating can be cited.

There are no particular restrictions on the solvent, which can be appropriately selected in accordance with the purpose, but examples include toluene, xylene, methyl ethyl ketone, methyl isobutyl ketone, cellosolve and butyl acetate.

There are no particular restrictions on the baking, and an external heating method may be used or an internal heating method may be used, and examples that can be cited include methods that use a fixed electric furnace, a flow-type electric furnace, a rotary electric furnace or a burner furnace, or methods that use microwaves.

The amount of carrier in the resin layer is preferably 0.01% by mass to 5.0% by mass. When this amount is less than 0.01% by mass, a uniform resin layer cannot be formed on the surface of the core, and when this exceeds 5.0% by mass, the resin layer becomes too thick, carrier particles aggregate and thus it results in failure to obtain uniformly-sized carrier particles.

Because the developer of the present invention contains the toner of the present invention, excellent low-temperature fixation and offset resistance can both be accomplished and it is possible to form good high-precision images.

The developer of the present invention can be suitably used in forming images through various commonly known electronic photography methods such as the magnetic single component developing method, the non-magnetic single component developing method or the two-component developing method, and can be suitably used in the non-magnetic single-component developing method. In addition, this can be particularly suitably used for the below-described toner container, process cartridge, image forming method and image forming apparatus.

(Toner Container)

The toner container used in the present invention houses the toner and the developer of the present invention.

There are no particular restrictions on the container, which can be appropriately selected from among those that are commonly known, and for example, one having a toner container body and cap can be cited.

There are no particular restrictions regarding the size, shape, structure or materials of the toner container body, and these can be appropriately selected in accordance with objective. As the shape, a cylindrical shape is preferable, and one with spiral-shaped ridges formed on the inner surface so that the toner contained therein can move toward the exit opening as the container is rotated can be used, and particularly preferable is one in which a portion or all of the spiral portion has a bellows function.

There are no particular restrictions on the materials of the toner container body, and these can be appropriately selected in accordance with purpose. However, those that can ensure precise dimensional tolerance are preferable, and for example, resins can be suitably cited, and among these, examples that can be suitably cited include polyester resins, polyethylene resins, polypropylene resins, polystyrene resins, polyvinyl chloride resins, polyacryl resins, polycarbonate resins, ABS resins and polyacetal resins.

The toner container makes storage and transportation easy, is easy to handle and can be detachably mounted to the below-described process cartridge and image forming apparatus of the present invention for toner supply.

(Process Cartridge)

The process cartridge used in the present invention has at least a latent electrostatic image bearing member for bearing thereon an electrostatic image, and a developing unit configured to develop the electrostatic image held on the latent electrostatic image bearing member by use of the toner to form a visible image, and has a charging unit, re-charging unit, transfer unit and cleaning unit, and other unit(s) suitably selected as needed.

The developing unit has at least a developer container that stores s the toner and developer of the present invention, and a developer bearing member that bears and conveys the toner and developer stored in the developer container, and may also have a layer thickness regulating member for regulating the thickness of the toner held.

The re-charging unit is a unit configured to re-charge, by using of re-charging member, residual toner particles left on the latent electrostatic bearing member after the transferring step.

The process cartridge can be detachably mounted to various types of image forming apparatuses and is preferably detachably mounted the below-described image forming apparatus of the present invention.

The process cartridge has a built-in photoconductor 101 and besides that is equipped with a charging unit 102, a developing unit 104, a transfer unit 108, a cleaning unit 107 and at least one charge elimination unit (unrepresented), and is an apparatus (part) that is removable from the image forming apparatus main body.

When showing the process of forming the image by the process cartridge as shown in FIG. 1, while the photoconductor 101 rotates in the direction indicated by the arrow, an electrostatic image corresponding to an exposure image is formed on the surface thereof by charging by the charging unit 102 and exposure 103 by an exposure unit (not shown). This electrostatic image is toner developed by the developing unit 104, the toner developing is transferred by the transfer unit 108 to a recording medium 105 and is printed out. Next, the surface of the photoconductor after the image transfer is cleaned by the cleaning unit 107 and then the electric charge is eliminated by the charge elimination unit (not shown), and the above operations are repeated.

(Image Forming Apparatus and Image Forming Method)

The image forming apparatus of the present invention has at least a latent electrostatic image bearing member, an electrostatic image forming unit, a developing unit, a transfer unit and a fixing unit, and may further have other appropriately selected units as needed, for example a charge elimination unit, re-charging unit, a cleaning unit, a recycling unit and a control unit.

The image forming method of the present invention includes at least a latent electrostatic image forming step, a developing step, a transfer step and a fixing step, and may further have other appropriately selected processes as needed, for example a re-charging step, charge elimination process, a cleaning process, a recycling process or a control process.

The image forming method of the present invention can be suitably carried out by the image forming apparatus of the present invention, the latent electrostatic image forming step can be effected by the latent electrostatic image forming unit, the developing step can be effected by the developing unit, the transfer step can be effected by the transfer unit, the fixing step can be effected by the fixing unit and the other steps can be effected by other units.

--Latent Electrostatic Image Forming Step and Latent Electrostatic Forming Unit--

The latent electrostatic image forming step is a step for forming a latent electrostatic image on the latent electrostatic image bearing member.

There are no particular restrictions on the materials, shape, structure and size of the latent electrostatic image bearing member (sometimes called the "photoconductive insulating unit," the "electrophotographic photoconductor," and the "photoconductor"), and these can be appropriately selected from among commonly known ones, but a drum shape may be appropriately cited as the shape, and as materials, inorganic photoconductors such as amorphous silicon or selenium, or organic photoconductors such as polysilane or phthalopolymetin. Of these, amorphous silicon is preferable from the perspective of longevity.

As the amorphous silicon photoconductor, it is possible to use a photoconductor having a photoconductive layer composed of a-Si (hereafter referred to as the "a-Si photoconductor") by heating the support unit to 50° C. to 400° C. and the applying a film-forming method on the support unit, such as a vacuum evaporation method, a sputtering method, an ion plating method, a heat CVD method, a light CVD method or a plasma CVD method. Among these, the plasma CVD method, that is to say a method that forms an a-Si accumulation film on the support unit by breaking down the raw material gas through direct current or high-frequency or microwave glow discharge, is ideal.

Formation of the latent electrostatic image can be accomplished for example by uniformly charging the surface of the latent electrostatic image bearing member and then image-wisely exposing it. This can be accomplished by the latent electrostatic image forming unit.

The latent electrostatic image forming unit is provided with at least an charging device for uniformly charging the surface of the latent electrostatic image bearing member and an exposure device for exposing the surface of the latent electrostatic image bearing member to an image.

Charging can be accomplished for example by impressing an electric potential on the surface of the latent electrostatic image bearing member using the charging device.

There are no particular restrictions on the charging device, which can be selected appropriately in accordance with the purpose, but examples include commonly known contact charging devices provided with conductive or semiconductive rollers, brushes, films or rubber blades, or non-contact charging devices that use corona discharge such as a corotron or scorotron.

The shape of the charging member may be rollers, magnetic brushes, fur brushes or the like, in any configuration, and can be selected in accordance with the specifications and shape of the electrophotographic apparatus. When using magnetic brushes, the magnetic brushes may be Zn—Cu ferrite or the like, and various ferrite particles may be used as charging members, and may be composed of a non-magnetic conductive sleeve for supporting these with magnet rollers contained within. Or, when brushes are used, as the material for the fur brushes, fur conductively treated by carbon, copper sulfide, metal or metal oxides may be used, and a charging device can be created by wrapping this around a metal or other conductively treated core.

The charging device is not limited to the above-described contact-type charging devices, but because an image forming apparatus in which ozone emitted from the charging device is reduced can be obtained, using a contact-type charging device is preferable.

Exposure can be accomplished by exposing the surface of the latent electrostatic image bearing member to an image using the exposure device.

There are no particular restrictions on the exposure device to the extent that this can accomplish exposure of the image to be formed on the surface of the latent electrostatic image bearing member charged by the charging ability unit, and this exposure device can be appropriately selected in accordance with purpose. Various types of exposure devices can be cited, such as a rod lens array system, a laser optical system or a liquid crystal shutter optical system.

In the present invention, an optical rear surface method may also be utilized wherein exposure is accomplished on the image from the rear surface of the latent electrostatic image bearing member.

--Developing Process and Developing Unit--

The developing step is a step for forming a visible image by developing a latent electrostatic image using the toner and developer of the present invention.

Forming the visible image can be accomplished by developing the latent electrostatic image using the toner and developer of the present invention and can be accomplished by the developing unit.

There are no particular restrictions on the developing unit to the extent that this unit can accomplish developing using the toner and developer of the present invention, and this unit can be appropriately selected from among commonly known ones. For example, a unit having at least a developing device that can store the toner and developer of the present invention and give through contact or non-contact the toner and developer to the electrostatic image can be cited, and a developing device equipped with the toner container of the present invention is more preferable.

The developing device may be a dry developing type or may be a wet developing type, and in addition, may be a monochrome developing device or a polychromatic developing device. For example, a developing device having an agitator that electrifies the toner and developer through friction agitation, and a rotatable magnet roller can be suitably cited.

Inside the developing device, a magnetic brush may be formed such that the toner and carrier are mixed together and agitated, and through the resulting friction the toner is electrified and is stored in an accumulated state on the surface of the rotating magnet roller. The magnet roller is positioned near the latent electrostatic image bearing member (photoconductor), and hence a portion of the toner that constitutes the magnetic brushes that are formed on the surface of the magnet rollers moves to the surface of the latent electrostatic image bearing member (photoconductor) by electrical attraction. As a result, the electrostatic image is developed by the toner and a visible image is formed by the toner on the surface of the latent electrostatic image bearing member (photoconductor).

The developer contained in the developing device is a developer that contains the toner of the present invention, but the developer may be a one-component developer or a two-component developer. The toner contained in the developer is the toner of the present invention.

--Transfer Step and Transfer Unit--

The transfer step is a step for transferring the visible image to a recording medium, but it is preferable to have a configuration in which an intermediate transfer unit is used, a first transfer of the visible image to this intermediate transfer unit is accomplished and then a second transfer of the visible image to the recording medium is accomplished. As the toner, a two-color or more toner may be used, and preferably a full-color toner is used. A configuration containing a first transfer step that forms a composite transfer image by transferring the visible image to the intermediate transfer unit and a second transfer step that transfers the composite transfer image to the recording medium is more preferable.

The transfer can be accomplished by charging the latent electrostatic image bearing member (photoconductor) using the charging unit, and can be accomplished by the transfer unit. As the transfer unit, it is preferable to have a configuration with a first transfer unit that transfers the visible image to an intermediate transfer unit and forms a composite transfer image, and a second transfer unit that transfers the composite transfer image to the recording medium.

There are no particular restrictions on the intermediate transfer unit, which can be appropriately selected from among commonly known transfer units in accordance with the objective, and for example a transfer belt can be suitably cited.

The static friction coefficient of the intermediate transfer unit is preferably 0.1 to 0.6, and more preferably 0.3 to 0.5. The volume resistance of the intermediate transfer unit is preferably several Ω-cm or higher to $10^3$ Ω-cm or less. By having the volume resistance be several Ω-cm or higher to $10^3$ Ω-cm or less, charging ability of the intermediate transfer unit itself is prevented and charge granted by the charge granting unit is less likely to stay behind on the intermediate transfer unit, and hence transfer inconsistencies during the second transfer can be prevented. In addition, it is easy to impress a transfer bias during the second transfer.

There are no particular restrictions on the materials of the intermediate transfer unit, and these may be selected appropriately from commonly known materials in accordance with the objective. For example, (1) materials with a high Young's modulus (tensile elastic modulus) may be used as a single-layer belt, and PC (polycarbonate), PVDF (polyvinyl fluoride), PAT (polyalkylene terephthalate), PC (polycarbonate)/PAT (polyalkylene terephthalate) blend materials, ETFE (ethylene tetrafluoroethylene copolymer/PC, ETFE/PAC, PC/PAT blend materials, or thermosetting polyimides with dispersed carbon black can be cited. These single-layer belts with high Young's modulus have little deformation with respect to stress during image formation, and in particular have the benefit that registration shifting does not readily occur during color image formation. (2) The material is a belt with a 2-3 layer composition, with the belt having a high Young's modulus as the base layer and a surface layer or intermediate layer granted on the outer circumference of that, and this belt with 2-3 layer composition prevents skips in linear images caused by the hardness of single-layer belts. (3) The material is a belt with a relatively low Young's modulus using rubber and elastomers, and these belts have the advantage that skips in the linear images virtually do not occur because of the softness of the belts. In addition, the belt width is larger than the drive rollers and suspension rollers and this prevents meandering by using the elasticity of the belt ear protruding from the rollers, thereby obviating the need for a rib or meandering prevention apparatus and making it possible to realize low costs.

The intermediate transfer belt from before has used fluoride-type resins, polycarbonate resins and polyimide resins, but in recent years an elastic belt made of elastic members has been used for the entire belt layer and portions of the belt. Transferring color images using a resin belt presents the following issues.

A color image is typically formed using colored toner in four colors. A single color image is formed by toner layers from the first layer through the fourth layer. By passing through a first transfer (the transfer from the photoconductor to the intermediate transfer belt) and a second transfer (the transfer from the intermediate transfer belt to the sheet), the toner layer receives pressure and the cohesive force among toner particles increases. When the cohesive force among toner particles increases, the phenomena of skipping in characters and edge skips in solid images readily occur. The resin belt has high rigidity and cannot deform in accordance with the toner layer, and hence, the toner layer is easily compressed and the phenomenon of skips in characters easily occurs.

In addition, recently demands have grown for forming full-color images on various kinds of paper, such as Japanese paper or paper deliberately endowed with roughness. However, paper with poor smoothness easily causes gaps with the toner during transfer, so transfer misses easily occur. When the transfer pressure in the second transfer area is increased in order to increase adhesion, the cohesion of the toner layer increases and this causes skipping in the characters as described above.

The elastic belt is used for the following purpose. The elastic belt deforms in response to the toner layer and paper with poor flatness in the transfer area. In other words, because the elastic belt deforms following local unevenness, it is possible to obtain uniformly good transfer images even on paper with poor flatness without increasing the transfer pressure on the toner layer excessively and without causing skips in the characters, while obtaining good adhesiveness.

As the resin of the elastic belt, it is possible to use one type, or combinations of two or more types, selected for example from the following groups: polycarbonates, fluorine-type resins (EFTE, PVDF), polystyrenes, chloropolystyrenes, poly-α-methylstyrenes, styrene-butadiene copolymers, styrene-vinyl chloride copolymers, styrene-vinyl acetate copolymers, styrene-maleic acid copolymers, styrene-ester acrylate copolymers (for example, styrene-methyl acrylate copolymers, styrene-ethyl acrylate copolymers, styrene-butyl acrylate copolymers, styrene-octyl acrylate copolymers or styrene-phenyl acrylate copolymers), styrene-ester methacrylate copolymers (for example, styrene-methyl methacrylate copolymers, styrene-ethyl methacrylate copolymers or styrene-phenyl methacrylate copolymers), styrene-α-methyl chloracrylate copolymers, styrene-acrylonitrile-acrylate ester copolymers and other styrene-based resins (for example, monomers or copolymers containing styrene or styrene substitutes), methyl methacrylate resins, butyl methacrylate resins, ethyl acrylate resins, butyl acrylate resins, modified acrylic resins (for example, silicon modified acrylic resin, vinyl chloride resin modified acrylic resin or acryl-urethane resin), vinyl chloride resins, styrene-vinyl acetate copolymers, vinyl chloride-vinyl acetate copolymers, rosin modified maleic acid resins, phenol resins, epoxy resins, polyester resins, polyester polyurethane resins, polyethylene, polypropylene, polybutadiene, polyvinylidene chloride, ionomer resins, polyurethane resins, silicone resins, ketone resins, ethylene-ethyl acrylate copolymers, xylem resins and polyvinyl butyral resins, polyamide resins or modified polyphenylene oxide resins. Naturally, there are no restrictions on the above-described materials.

There are no particular restrictions on the elastic rubbers or elastomers, which may be selected appropriately in accordance with the objective, and for example it is possible to use one type, or a combination of two or more types, selected from the following groups: butyl rubber, fluorine-based rubber, acrylic rubber, EPDM, MBR, acrylonitrile-butadiene-styrene rubber natural rubber, isoprene rubber, styrene-butadiene rubber, butadiene rubber, ethylene-propylene rubber, ethylene-propylene terpolymer, chloroprene rubber, polyethylene chlorosulfonate, polyethylene chloride, urethane rubber, syndiotactic 1,2-polybutadiene, epichlorohydrin rubber, silicone rubber, fluorine rubber, polysulfide rubber, polynorbornene rubber, nitrile hydroxide rubber or thermoplastic elastomers (for example, polystyrene-type, polyolefin-type, polyvinyl chloride-type, polyurethane-type, polyamide-type, polyurea, polyester-type or fluorine resin).

There are no particular restrictions on the conductive agent used to adjust the resistance value, and this can be appropriately selected in accordance with the objective, and for example these may be carbon black, graphite, metal powders such as aluminum or nickel, tin oxide, titanium oxide, antimony oxide, indium oxide, potassium titanate, antimony-tin composite oxide (ATO), or indium-tin composite oxide (ITO), or other conductive metal oxides, and the conductive metal oxides may cover insulating fine particles such as barium sulfide, magnesium silicide or calcium carbonate. It is obvious that there are no restrictions on the above-described conductive agents.

The cover materials and cover layer need to prevent soiling of the photoconductor by the elastic materials, and have high second transferability and cleanability by reducing the adhesiveness of the toner and reducing the surface friction resistance to the transfer belt surface. It is possible to use materials that increase lubrication and reduce surface energy by using one type or a combination of two or more out of polyurethane, polyester or epoxy resins, or disperse combinations with particles of different diameter or one type or two or more types of powders or particles such as, for example, fluorine resins, fluorine compounds, carbon fluorides, titanium dioxides or silicon carbide. In addition, it is possible to use materials in which a fluorine-rich layer is formed on the surface by accomplishing heat treatment such as on fluorine-based rubber materials and through this the surface energy is reduced.

There are no particular restrictions on the belt manufacturing method, and for example methods that can be cited include a centrifuge method that forms the belt by pouring materials into a cylindrical mold that rotates, a spray coating method that forms a film by spraying the liquid coating material, a dipping method wherein a cylindrical mold is dipped into a solution of the material, a pouring mold method in which the material is poured into internal molds and external molds, or a method that winds the compound around a cylindrical mold and accomplishes sulfurizing polishing, but these are intended for illustrative purpose only and not limiting; for typically belts are manufactured by combining multiple manufacturing methods.

As a method for preventing stretching as an elastic belt, there is a method that forms a rubber layer on a core resin layer that does not stretch and a method that pours onto the core layer a material that prevents stretching, but this is not limited to a particular manufacturing method.

As the material that composes the core layer that prevents stretching, there are no particular limitations and the material can be appropriately selected in accordance with the objective, and for example natural fibers such as cotton or silk; synthetic fibers such as polyester fibers, nylon fibers, acrylic fibers, polyolefin fibers, polyvinyl alcohol fibers, polyvinyl chloride fibers, polyvinylidene fibers, polyurethane fibers, polyacetal fibers, polyfluoroethylene fibers or phenol fibers; inorganic fibers such as carbon fibers, glass fibers or boron fibers; or metal fibers such as iron fibers or copper fibers can be used, and materials in a woven cloth shape or yarn shape can also be used.

The yarn may be one or a plurality of filaments twisted together, and any twisting method is fine, such as single-twist yarn, multiple-twist yarn and double yarn. In addition, the fibers of the materials selected from the above-describe materials group may be mixed. In addition, a suitable conductive treatment may be used on the yarn. On the other hand, for the woven cloth it is possible to use woven cloth woven with stockinet weaving or the like, and mixed weave woven cloth can also be used, and naturally conductive treatment can also be accomplished.

The manufacturing method for the core layer is not particularly restricted and can be appropriately selected in accordance with the objective, and for example it is possible to use a method that covers the metal mold with a woven cloth woven in a cylindrical shape, and provides a covering layer thereon; a method that immerses a woven cloth woven in a cylindrical shape into liquid rubber of the like, and provides a cover layer for one or both surfaces of the core layer, or a method that winds the yarn in a spiral shape at an arbitrary pitch on the metal mold and provides a cover layer thereon.

The thickness of the elastic layer depends on the rigidity of the elastic layer, but if this is too thick, the elasticity of the surface will become too large and cracks can easily form in the surface layer. In addition, because the expansion and contraction of the image becomes large when the elasticity becomes large, it is not preferable for the layer to be too thick (around 1 mm or thicker).

The transfer unit (first transfer unit and second transfer unit) preferably has at least a transfer device that detachably charges the visible image formed on the latent electrostatic image bearing member (photoconductor) onto the recording medium. There may be one transfer unit, or two or more. As the transfer device, a corona transfer device using corona discharge, a transfer belt, a transfer roller, a pressure transfer roller, an adhesion transfer roller or the like can be cited.

As the recording medium, the representative example is regular paper, but there are no particular limitations as long as the medium is capable of transferring the unfixed image after developing, and the medium can be appropriately selected in accordance with the objective, and OHP PET base can also be used.

The fixing step is a step for fixing the visible image transferred to the recording medium using a fixing device, and this may be accomplished each time a transfer to the recording medium is made for each color of toner, or this may be accomplished simultaneously one time after each color of toner has been accumulated.

There are no particular restrictions on the fixing device, which can be appropriately selected in accordance with the objective, but a commonly known heating and pressure unit is suitable. As the heating and pressure unit, a combination of a heating roller and pressure roller, or a combination of a heating roller, a pressure roller and an endless belt can be cited.

It is preferable for the heat in the heating and pressure unit to be typically 80° C. to 200° C.

In the present invention, a commonly known photo fixing device, for example, may also be used in accordance with the objective, either together with the fixing process and fixing unit or as a substitute for those.

The re-charging step is a step of re-charging using a recharging member toner particles remained on the latent electrostatic image bearing member after transferring step, and is suitably accomplished by the re-charging unit. The re-charging member is preferably a sheet made of material selected from nylon, PTFE, PVDF and urethane.

The re-charging member preferably has a surface resistance of $10^2$ Ω/sq to $10^8$ Ω/sq and volume resistance of $10^1$ Ω/sq to $10^5$ Ω/sq. The re-charging member is preferably of roller, brush, or sheet shape; however, sheet shape is most preferable for complete removal of residual toner particles.

The voltage applied to the re-charging member is preferably −1.4 kV to 0 kV in view of imparting charge to toner particles. PTFE and PVDF are more preferable in view of toner chargeability.

When the re-charging member is a conductive sheet, it is preferable that the conductive sheet have a thickness of 0.05 mm to 0.5 mm in view of contact pressure against a latent electrostatic image bearing member. Moreover, the nip width between the latent electrostatic image bearing member and the re-charging member is preferably 1 mm to 10 mm in view of contact time for imparting charge to toner particles.

The water contact angle of the conductive sheet can be measured with a drop method using a contact angle meter (CA-DT A model, manufactured by Kyowa Interface Science Co., Ltd.) in accordance with its manual; the conductive sheet preferably has a water contact angle of 108° or wider.

The shore D hardness of the conductive sheet can be measured with a method conforming to ASTM D-2240, and is preferably 50 to 65 at 25° C.

Figure 8:
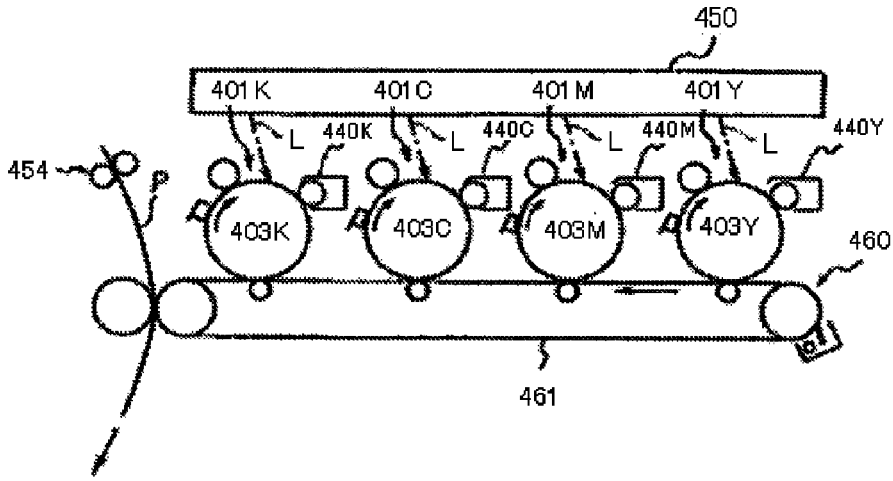
FIG. 8 is a schematic view showing a principle portion of an image forming apparatus to which the process cartridge used in the present invention can be applied.

Here, FIG. 8 shows a schematic diagram showing a principle portion of an image forming apparatus (printer) to which a process cartridge according to this embodiment can be applied. This printer is equipped with four process cartridges 401Y, 401M, 401C and 401K for forming toner images of their respective colors—Yellow, Magenta, Cyan, and Black (hereinafter abbreviated as Y, M, C, and K respectively). The printer is also equipped with an optical write unit 450, a pair of resist rollers 454, a transfer unit 460 and so forth. Note that subscripts Y, M, C, and K attached to the ends of reference numerals indicate that members attached with those subscripts are used for toners of corresponding colors.

The optical write unit 450, a latent electrostatic image forming unit, includes a light source consisting of four laser diodes for different colors Y, M, C, and K; a polygonal mirror (regular hexahedron), a polygon motor for driving the mirror to rotate; a fθ lens, a lens, a reflection mirror, and the like. A laser beam L emitted from one of the laser diodes is reflected by one of the surfaces of the polygonal mirror, polarized along the rotation of the polygonal mirror, and reaches to any one of four photoconductors to be described later. Laser beams L emitted from four laser diodes sweep over the surface of corresponding photoconductors.

The process cartridges 401Y, 401M, 401C and 401K include, respectively, as a latent electrostatic image bearing member, drum-shaped photoconductors 403Y, 403M, 403C and 403K; as a developing unit, developing devices 440Y, 440M, 440C and 440K respectively corresponding to the photoconductors 403Y, 403M, 403C and 403K; charging devices; and the like. Each of the photoconductors 403Y, 403M, 403C and 403K is driven to rotate in clockwise direction in the drawing at a given linear velocity by means of drive means (not shown), and is scanned under dark condition by means of the optical write unit 450 emitting a laser beam L modulated on the basis of the image information transmitted from a personal computer or the like (not shown), whereby each photoconductor bears thereon a latent electrostatic image for corresponding color.

Figure 9:
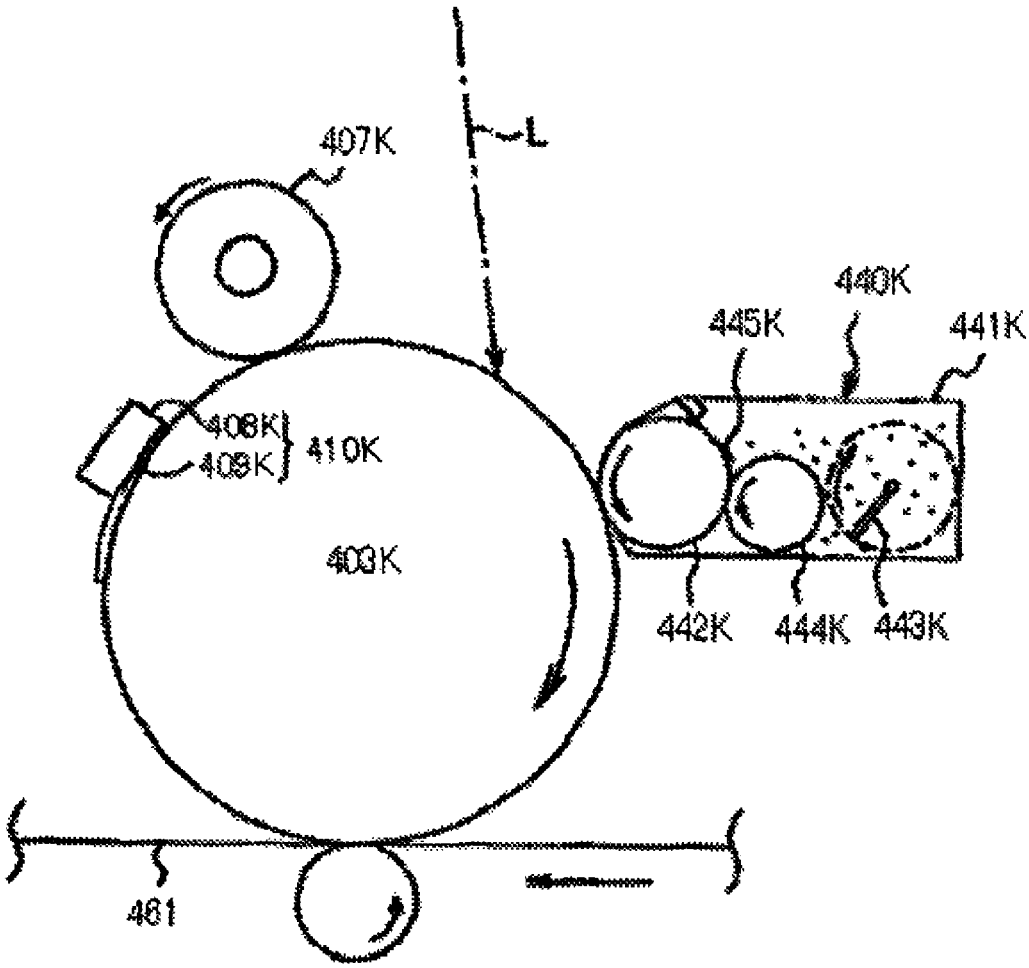
FIG. 9 is an enlarged view showing a process cartridge for black color and the vicinity thereof.

FIG. 9 is a enlarged schematic view showing, among four process cartridges 401Y, 401M, 401C and 401K, the process cartridge 401K (for black) together with an intermediate transfer belt 461 of the transfer unit (460 in FIG. 8). In this drawing the process cartridge 401K includes the photoconductor 403K, charging device, charge removing lamp (not shown), developing device (440K) or developing unit, and the like in a common unit casing (container) as a single unit, the casing being adapted to be detachably mounted to the printer main body.

The photoconductor 403K for black, an article to be charged and also a latent electrostatic image bearing member, is a drum-shaped conductive substrate formed of aluminum tube that is about 24 mm in diameter and covered with a photosensitive layer made of negatively charged organic photoconductive material, and is driven to rotate in clockwise direction in FIG. 9 at a given linear velocity by means of drive means (not shown). In this way, a point of the photoconductor 403K surface passes through, in order, a first transfer nip (contact point to the intermediate transfer belt 461), an auxiliary charging nip, charging nip, optical writing point, and development area.

The developing device 440K includes a developing roller 442K whose circumferential surface is partially exposed out of the opening provided in the casing 441K. The developing roller 442K, or developer bearing member, is rotatably held to a bearing (not shown) by the shaft protruding from both ends of the roller. The casing 441 stores therein K toner which is transported from right to left in the drawing by means of an agitator 443K that is driven to rotate. At the left side of the agitator 443K in the drawing there is provided a toner supply roller 444K that is driven to rotate in anticlockwise direction in the drawing by means of drive means (not shown). The roller portion of this toner supply roller 444K is made of elastic foam such as sponge, and thereby efficiently catches K toner particles transferred from the agitator 443K. The K toner particles thus captured are then supplied to the developing roller 442K at the contact portion against the toner supply roller 444K. The K toner particles that are attached to the surface of the developing roller 442K or developer bearing member, then pass through the contact position against a regulation blade 445K along with the anticlockwise rotation of the developing roller 442K in the drawing, during which the toner layer is made uniform and frictional charging is facilitated. Thereafter, the toner particles are transferred to the development area facing the photoconductor 403K.

In this development area a development potential is acted between the developing roller 442K to be applied with a negatively charged development bias output from power source (not shown) and the latent image held on the photoconductor 403K for electrostatically transferring negatively charged K toner particles from the developing roller 442K to the latent image. Furthermore, a non-development potential is acted between the developing roller 442K and a uniformly charged portion (background) of the photoconductor 403K for electrostatically transferring negatively charged K toner particles from the background to the developing roller 442K. The K toner particles held on the developing roller 442K are separated from the developing roller 442K by action of the development potential and transferred onto the latent electrostatic image held on the photoconductor 403K. By this, the latent electrostatic image is developed into a K toner image.

Although a one-component development system that uses a one-component developer composed primarily of K toner is employed for the developing device 440K in the printer described above, a two-component development system may be employed that uses a two-component developer containing both K toner and magnetic carrier.

The K toner image formed in the development area is then transferred along with the rotation of the photoconductor 403K to the first transfer nip for black, a position where the photoconductor 403K contacts the intermediate transfer belt 461, and the K toner image is transferred to the intermediate transfer belt 461. The surface of the photoconductor 403K that has passed through the first transfer nip has residual toner particles attached that failed to be transferred onto the intermediate transfer belt 461.

The charging device includes a charging brush roller 407K that is driven to rotate in anticlockwise direction in the drawing and contacts the photoconductor 403K to form a charging nip; an auxiliary charging member 410K that contacts the photoconductor 403K to form an auxiliary charging nip; and the like. The charging brush roller 407K is a metallic rotary shaft covered with a roller part made of conductive and elastic material such as conductive rubber. A charging bias is applied to the rotary shaft by means of a charging bias supply unit (not shown) composed of power source and the like. This leads to generation of discharge between the charging brush roller 407K and the photoconductor 403K and thereby the surface of the photoconductor 403K is uniformly charged to the same polarity as toner.

The auxiliary charging member 410K is a member composed of an elastic part 408K made of such elastic material as sponge, and of a conductive sheet (re-charging member) 409K made of conductive material covering the surface of the elastic part 408K. The sheet-covered surface of the auxiliary charging member 410K is pressed against the circumferential surface of the photoconductor 403K by means of the elastic part 408K at a portion between the first transfer nip and the above-noted charging nip. An auxiliary charging bias, which is composed either of direct current of the same polarity as the toner or alternating voltage superimposed with this direct voltage, is supplied to the conductive sheet 409K by means of the auxiliary charging bias supply unit composed of power source or the like (not shown).

Residual toner particles left on the surface of the photoconductor 403K after the first transfer nip are of various types: toner particles with a proper polarity; toner particles with a proper polarity but at lower charge levels; toner particles with opposite polarity; and so forth. These residual toner particles are ended up entering the auxiliary charging nip along with the rotation of the photoconductor 403K. At this point, the oppositely charged toner particles are fully charged to have a proper polarity—negative polarity—by means of discharge between the auxiliary charging member 410K and photoconductor 403K or by means of charge infusion from the auxiliary charging member 410K. In addition, the low-charge level toner particles are also fully charged to have a negative polarity by charge infusion. In this way it is possible to prevent occurrence of soiling of photoconductor due to unwanted transfer of oppositely charged toner particles and low-charge level toner particles among residual toner particles into the development area.

Next, a cleaner-less type image forming apparatus will be described in detail. The cleaner-less systems are broadly grouped under scatter-pass type, temporal capturing type, and combination of the foregoing. Among them, the scatter-pass type cleaner-less system uses a scattering member such as a brush that is frictionally in contact with the latent electrostatic image bearing member such that residual toner particles on the latent electrostatic image bearing member are scratched to reduce the binding force between the toner particles and the latent electrostatic image bearing member. Subsequently, the residual toner particles on the latent electrostatic image bearing member are electrostatically transferred on a developing member (e.g., developing roller) in or immediately before the development area where developing members such as a developing sleeve and developing roller face the latent electrostatic image bearing member, thereby recovering the residual toner particles in the developing device. Although the residual toner particles passes through the optical write position where a latent image is formed prior to this recovery step, there is no adverse effects on writing of latent image provided that the amount of the residual toner particles is small. However, if the aforementioned oppositely charged toner particles are contained in the residual toner particles, it results in troubles such as soiling because they are not recovered on the developing member. To avoid this problem it is preferable to provide a toner charging unit for charging the residual toner particles to have a proper polarity between a transfer position (e.g., first transfer nip) and a scattering position by means of the scattering member, or between the scattering position and development area.

For the scattering member, it is possible to employ a fixed brush having multiple implanted fibers made of conductive fiber attached to a plate, unit casing or the like; a brush roller composed of a metallic rotary shaft provided with multiple upright implanted fibers; a roller member (e.g., charging roller) provided with a roller part made of conductive sponge or the like; and the like. While the fixed brush has an advantage that it is cost-effective because a relatively small amount of implanted fiber is required, when it is used also as a charging member for uniform charging of the latent electrostatic image bearing member, it results in failure to achieve sufficient charge uniformity. The brush roller, by contrast, is suitably used because sufficient charge uniformity can be ensured.

The temporal capturing type cleaner-less system uses a capturing member such as a rotating brush that endlessly runs over the latent electrostatic image bearing member's surface for temporal capture of residual toner particles thereon. Subsequently, after complete of a particular print job or during the interval between different print jobs for sheet feed, the residual toner particles captured by the capturing member are ejected for retransfer onto the latent electrostatic image bearing member, after which the toner particles are electrostatically transferred onto a developing member (e.g., developing roller) for recovery into the developing device. While the above-mentioned scatter-pass type presents a possibility of image degradation in cases where the amount of residual toner particles considerably increases upon formation of a solid image or after occurrence of paper jam and thus the toner recovery capability exceeds the limit, the temporal capturing type can prevent the occurrence of image degradation by recovering, little by little, the residual toner particles captured by the capturing member.

The combination type cleaner-less system uses scatter-pass type and temporal capturing type in combination. More specifically, a rotating brush member or the like that contacts a latent electrostatic image bearing member is used in combination with a scattering member and a capturing member. While allowing the rotating brush member or the like to serve as a scattering member by application of only direct voltage, the bias is switched from direct voltage to superimposed voltage where necessary, so that the rotating brush member or the like also serves as a capturing member.

The present invention employs the scatter-pass type cleaner-less system. More specifically. as shown in FIG. 9, the photoconductor 403K forms the first transfer nip while being driven to rotate in clockwise direction in the drawing at a given linear velocity and contacting the front surface of the intermediate transfer belt 461. By the auxiliary charging member 410K (i.e., elastic part 408K and conductive sheet 409K) and the charging brush roller 407K as scattering members, the residual toner particles on the photoconductor 403K are scratched, whereby the binding force between the residual toner particles and photoconductor 403K is reduced. Thereafter, in the development area, the residual toner particles on the photoconductor 403K are electrostatically transferred onto the developing roller 442K of the developing device 440K for recovery. At this point, if low-charge level toner particles and oppositely charged toner particles are abundantly contained in the residual toner particles, they fail to be recovered on the developing roller 442K and cause unwanted soiling. Furthermore, if a large amount of releasing agent is exposed to the toner surface, it induces toner adhesion, toner spent or the like to the charging brush roller 407K (member for charging a latent electrostatic image bearing member) and conductive sheet 409K (re-charging member), leading to an increased likelihood of generation of toner cake.

The cleaning step is a step for removing the electrophotographic toner that residually stays on the latent electrostatic image bearing member, and this can be suitably accomplished by the cleaning unit.

There are no particular restrictions on the cleaning unit, and this may be capable of removing the toner that residually stays on the latent electrostatic image bearing member. This unit can be appropriately selected from among commonly known cleaners, and for example, a magnetic brush cleaner, electrostatic brush cleaner, magnetic roller cleaner, blade cleaner, brush cleaner or web cleaner can be suitably cited.

The charge elimination step is a step for removing charge by impressing a charge elimination bias on the latent electrostatic image bearing member, and can be suitably accomplished by the charge elimination unit.

There are no particular restrictions on the charge elimination unit, and this may be capable of impressing a charge elimination bias on the latent electrostatic image bearing member and can be appropriately selected from among commonly known charge elimination devices, and for example, a charge elimination lamp can be suitably cited.

The recycling process is a process that recycles the toner removed by the cleaning process back to the developing unit, and can be suitably accomplished by the recycling unit.

There are no particular restrictions on the recycling unit, and a commonly known conveyance unit can be cited.

The control step is a step for controlling the various steps mentioned above, and can be suitably accomplished by the control unit.

There are no particular restrictions on the control unit to the extent that this unit can control the actions of the various units, and this may be appropriately selected in accordance with the objective. For example, equipment such as a sequencer or a computer can be cited.

Next, one embodiment of practicing the image forming method of the present invention by means of the image forming apparatus of the present invention will be explained with reference to FIG. 2. The image forming apparatus 100 shown in FIG. 2 is equipped with a photoconductor drum 10 (hereafter "photoconductor 10") as the latent electrostatic image bearing member, a charging roller 20 as the charging unit, an exposure apparatus 30 as the exposure unit, a developing device 40 as the developing unit, an intermediate transfer unit 50, a cleaning apparatus 60 as the cleaning unit having a cleaning blade, and a charge elimination lamp 70 as the charge elimination unit.

The intermediate transfer unit 50 is an endless belt and is designed to be moveable in the direction indicated by the arrow by three rollers positioned to this inside of this belt on which this belt is suspended. One of the three rollers 51 also functions as a transfer bias roller capable of impressing on the intermediate transfer unit 50 a predetermined transfer bias (first transfer bias). A cleaning apparatus 90 having a cleaning blade is positioned adjacent to the intermediate transfer unit 50, and in addition, a transfer roller 80 that acts as a transfer unit capable of impressing a transfer bias in order to transfer (second transfer) the developed image (toner image) onto transfer paper 95, which serves as the final recording medium, is positioned facing this apparatus. Around the intermediate transfer unit 50, a corona charging unit 58, which provides an electrical charge to the toner image on the intermediate transfer unit 50, is positioned between the area of contact between the photoconductor 10 and the intermediate transfer unit 50 and the area of contact between the intermediate transfer unit 50 and the transfer paper 95, in the direction of rotation of the intermediate transfer unit 50.

The developing unit 40 consists of a developing belt 41 that serves as the latent electrostatic image bearing member, and a black developing unit 45K, a yellow developing unit 45Y, a magenta developing unit 45M and a cyan developing unit 45C, provided around the perimeter of the developing belt 41. The black developing unit 45K is equipped with a developer container 42K, a developer supply roller 43K and a developing roller 44K; the yellow developing unit 45Y is equipped with a developer container 42Y, a developer supply roller 43Y and a developing roller 44Y; the magenta developing unit 45M is equipped with a developer container 42M, a developer supply roller 43M and a developing roller 44M; and the cyan developing unit 45C is equipped with a developer container 42C, a developer supply roller 43C and a developing roller 44C. In addition, the developing belt is an endless belt, is suspended so as to be capable of rotation on a plurality of belt rollers, and a portion of this belt makes contact with the photoconductor 10.

Figure 2:
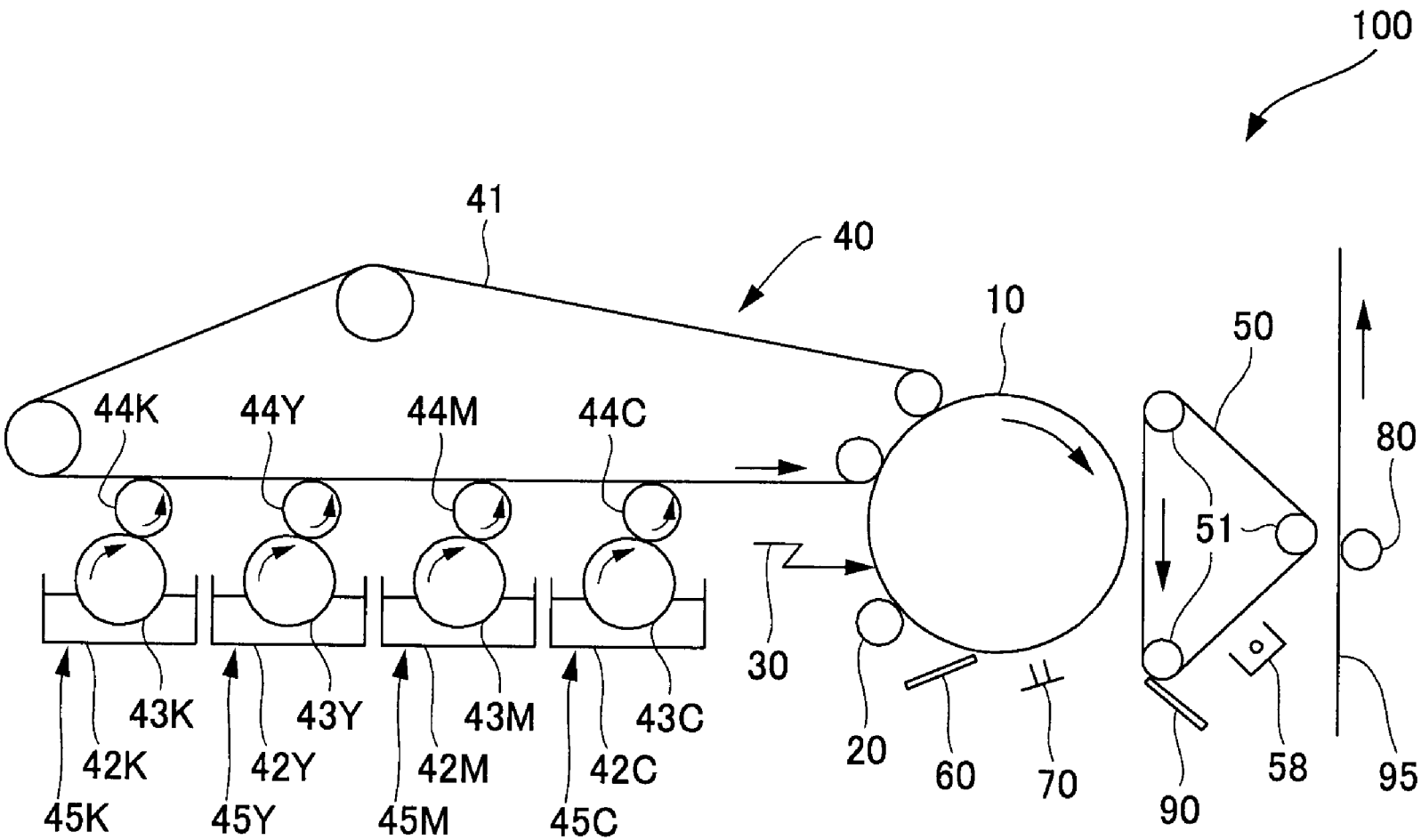
FIG. 2 is a schematic view showing one example of practicing an image forming method through the image forming apparatus used in the present invention.

In the image forming apparatus shown in FIG. 2, the charging roller 20 for example uniformly charges the photoconductor drum 10. The exposure apparatus 30 accomplishes exposure of an image on the photoconductor drum 10, forming an electrostatic image. The electrostatic image formed on the photoconductor drum 10 is developed by supplying toner from the developing device 40, thereby forming a toner image. This toner image is transferred (first transfer) onto the intermediate transfer unit 50 by a voltage being impressed from the roller 51, and is further transferred (second transfer) onto the transfer paper 95. As a result, a transfer image is formed on the transfer paper 95. The residual toner on the photoconductor 10 is removed by the cleaning apparatus 60 and the charge on the photoconductor 10 is eliminated by the charge elimination lamp 70.

Figure 3:
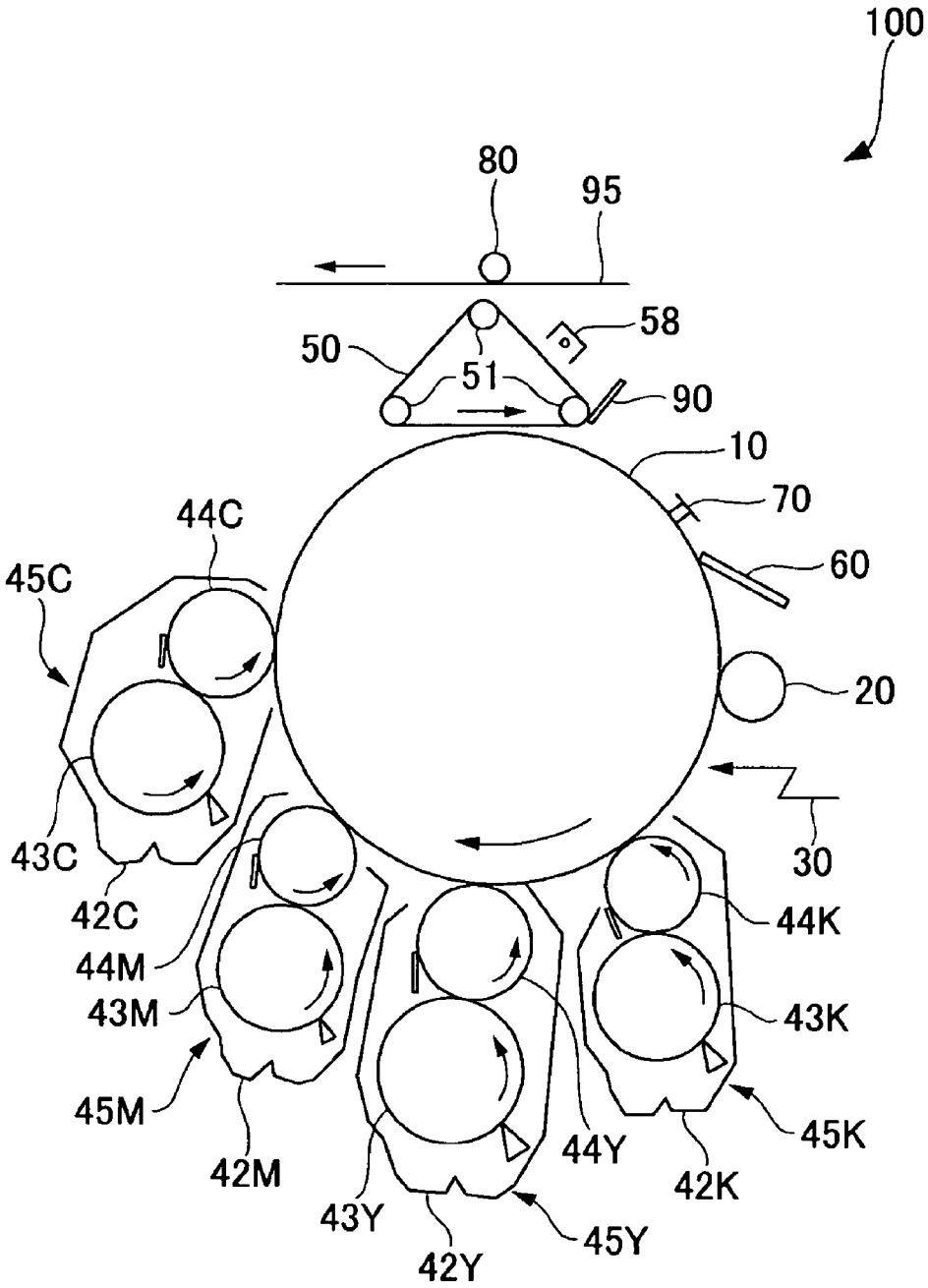
FIG. 3 is a schematic view showing another example of practicing the image forming method through the image forming apparatus used in the present invention.

Another embodiment for practicing the image forming method of the present invention by means of the image forming apparatus of the present invention is explained with reference to FIG. 3. The image forming apparatus 100 shown in FIG. 3 is not equipped with the developing belt 41 of the image forming apparatus 100 shown in FIG. 2 and has a black developing unit 45K, a yellow developing unit 46Y, a magenta developing unit 45M and a cyan developing unit 45C arranged directly facing the photoconductor 10 around the circumference thereof but otherwise has the same composition as the image forming apparatus shown in FIG. 2 and exhibits the same operational efficacy. In FIG. 3, parts that are the same as in FIG. 2 are indicated by the same reference numbers.

Figure 4:
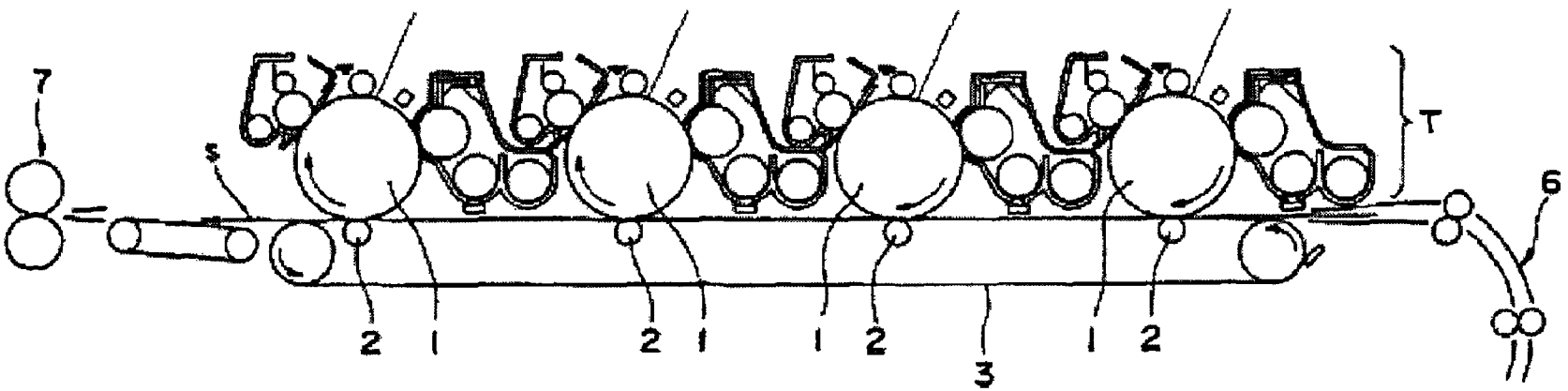
FIG. 4 is a partial exploded diagram showing one example of the image forming apparatus used in the present invention.
Figure 5:
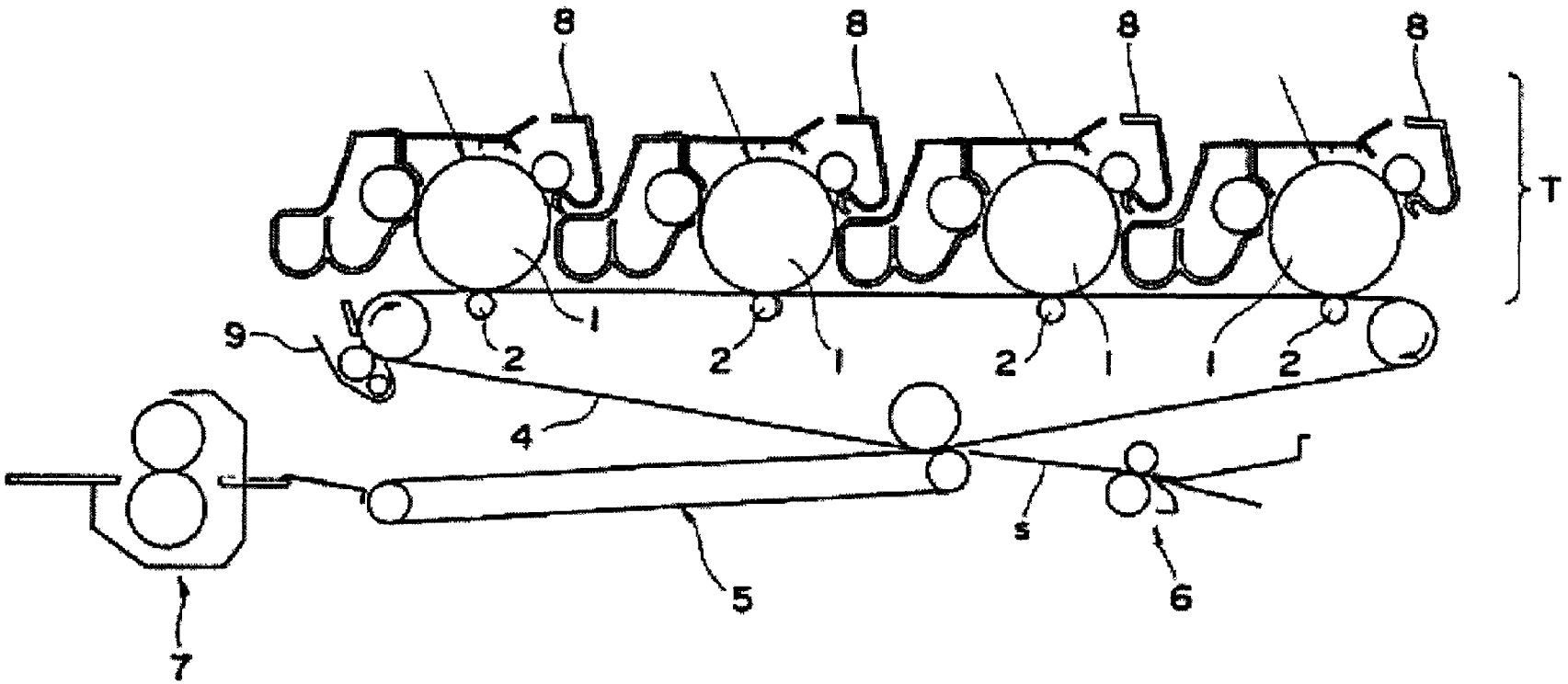
FIG. 5 is a partial exploded diagram showing another example of the image forming apparatus used in the present invention.

Tandem electrophotographic apparatuses that execute the image forming method of the present invention by means of the image forming apparatus of the present invention include a direct transfer method type in which the images on the photoconductors 1 are successively transferred by transfer apparatuses 2 to a sheet "s" conveyed by a sheet conveyance belt 3, as shown in FIG. 4, and an indirect transfer method type in which the images on the photoconductors 1 are successively transferred to an intermediate transfer unit 4 by first transfer apparatuses 2 and after this the images on the intermediate transfer unit 4 are transferred all together to a sheet "s" by a second transfer apparatus, as shown in FIG. 5. The transfer apparatus 5 is a transfer conveyance belt, but this may also be a roller shape.

Comparing the direct transfer method type with the indirect transfer method type, the former has the drawback that the paper supply apparatus 6 on the upstream side of the tandem image forming apparatus T in which the photoconductors are lined up must have a fixing device 7 on the downstream side, causing the device to become larger in the direction of sheet conveyance. In contrast to this, in the latter the second transfer apparatus can be placed with relative freedom. This means that the paper supply apparatus 7 and the fixing device 7 can be positioned overlapping the tandem image forming apparatus T, thereby offering the advantage that compactness is possible.

In addition, in the former, the fixing device 7 is positioned adjacent to the tandem image forming apparatus T in order to prevent largeness in the direction of sheet conveyance. For this reason, it is impossible to position the fixing device 7 with ample leeway so that the sheet "s" can bend, creating the drawback that because of the impact when the front edge of the sheet "s" enters the fixing device 7 (which is particularly striking with thick sheets), as well as the difference between the sheet conveyance speed as the sheet passes through the fixing device 7 and the sheet conveyance speed by the transfer conveyance belt, the fixing device 7 readily influences upstream image formation. In contrast, in the latter the fixing device 7 can be positioned with ample leeway so that the sheet "s" can bend, and hence the fixing device can be made to have virtually no influence on image formation.

From the above, recently attention has been focused particularly on indirect transfer method types among tandem electrophotographic apparatuses.

Furthermore, in color electrophotographic apparatuses of this type, the transfer residue toner that residually stays on the photoconductor 1 after the first transfer is removed by the photoconductor cleaning apparatus 8 and the photoconductor 1 surface is cleaned and prepared for image formation again, as shown in FIG. 5. In addition, the transfer residue toner that residually stays on the intermediate transfer unit 4 after the second transfer is removed by the intermediate transfer unit cleaning apparatus 9 and the intermediate transfer unit 4 surface is cleaned and prepared for image formation again.

Figure 6:
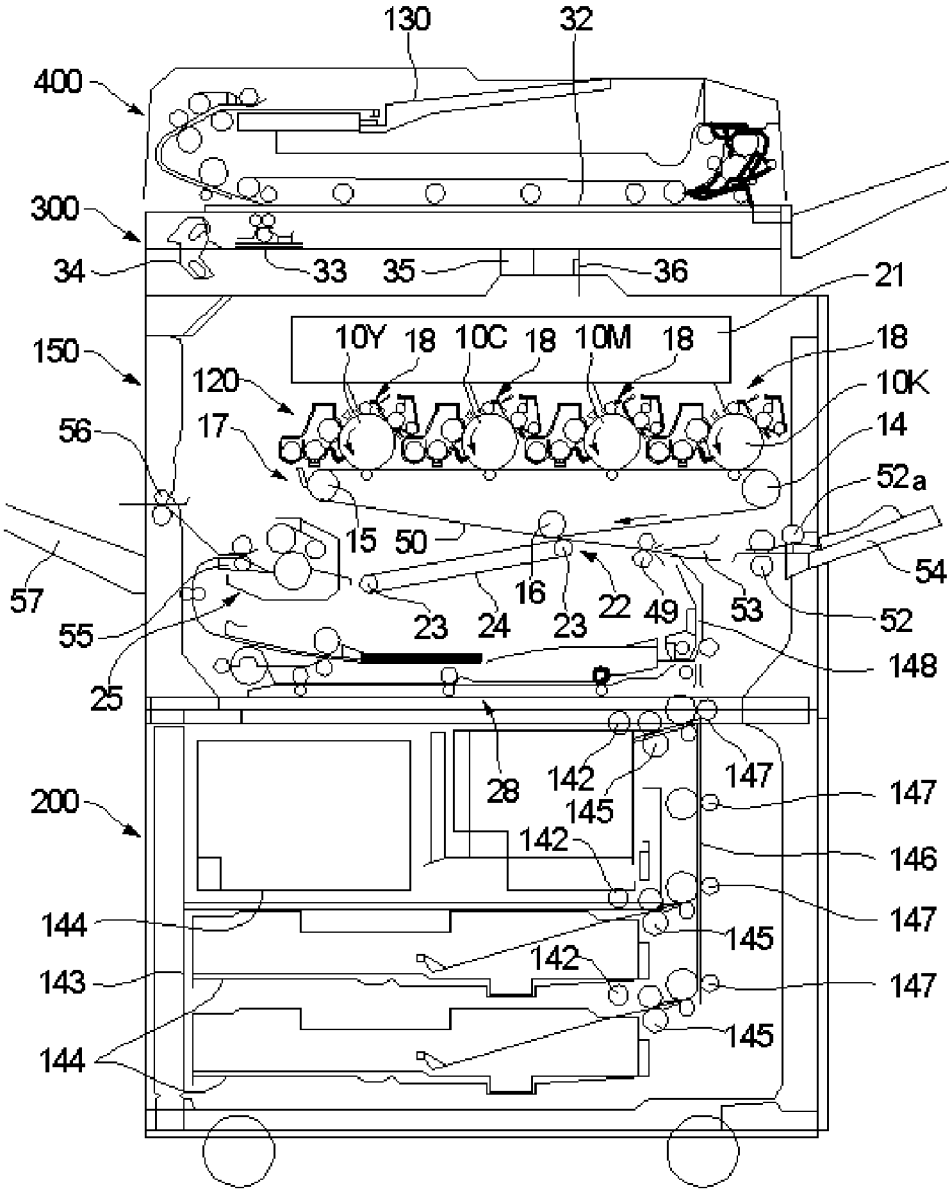
FIG. 6 is a schematic view showing one example of practicing the image forming method through the image forming apparatus (tandem-type color image forming apparatus) used in the present invention.

The tandem image forming apparatus 120 shown in FIG. 6 is a tandem color image forming apparatus. The tandem image forming apparatus 120 is provided with a copy apparatus main body 150, a paper supply table 200, a scanner 300 and an automatic document feeder (ADF) 400.

An intermediate transfer unit 50 in the shape of an endless belt is provided in the central area of the copy apparatus main body 150. Furthermore, the intermediate transfer unit 50 is suspended on support rollers 14, 15, and 16, and can rotate in clockwise direction in FIG. 6. Adjacent to the support roller 15, an intermediate transfer unit cleaning apparatus 17 is provided for removing residual toner from the intermediate transfer unit 50. In the intermediate transfer unit 50 suspended by the support roller 14 and the support roller 15, a tandem developing device 120 is provided in which four image-forming units 18 for yellow, cyan, magenta and black are arranged in parallel facing each other along the direction of conveyance. Adjacent to the tandem developing device 120 is an exposure apparatus 21. On the side of the intermediate transfer unit 50 opposite the side on which the tandem developing device 120 is arranged, a second transfer apparatus 22 is positioned. In the second transfer apparatus 22, a second transfer belt 24, which is an endless belt, is suspended on a pair of rollers 23 so that the transfer paper conveyed on the second transfer belt 24 and the intermediate transfer unit 50 can mutually make contact. A fixing device 25 is positioned adjacent to the second transfer apparatus 22.

In the tandem image forming apparatus 120, a sheet reversal apparatus 28 that reverses the transfer paper in order to accomplish image formation on both sides of the transfer paper is positioned adjacent to the second transfer apparatus 22 and the fixing device 25.

Next, the formation of a full color image (color copy) using the tandem developing device 120 will be explained. That is to say, an original document can first be set on the original tray 130 of the automatic document feeder (ADF), or the automatic document feeder 400 can be opened, the original document set on the contact glass 32 of the scanner 300, and the automatic document feeder 400 then closed.

When the start switch (not shown) is pressed, when the document is set in the automatic document feeder 400, after the document is fed in and is moved to the contact glass 32, or on the other hand, immediately when the document is set on the contact glass 32, the scanner 300 operates, and the first running unit 33 and second running unit 34 run. At this time, light from the light source is shone by the first running unit 33 and light reflected from the document surface is reflected by a mirror in the second running unit 34, the light is received by a reading sensor 36 via an imaging lens 35 and the color document (color image) is read and becomes the black, yellow, magenta and cyan image information.

Figure 7:
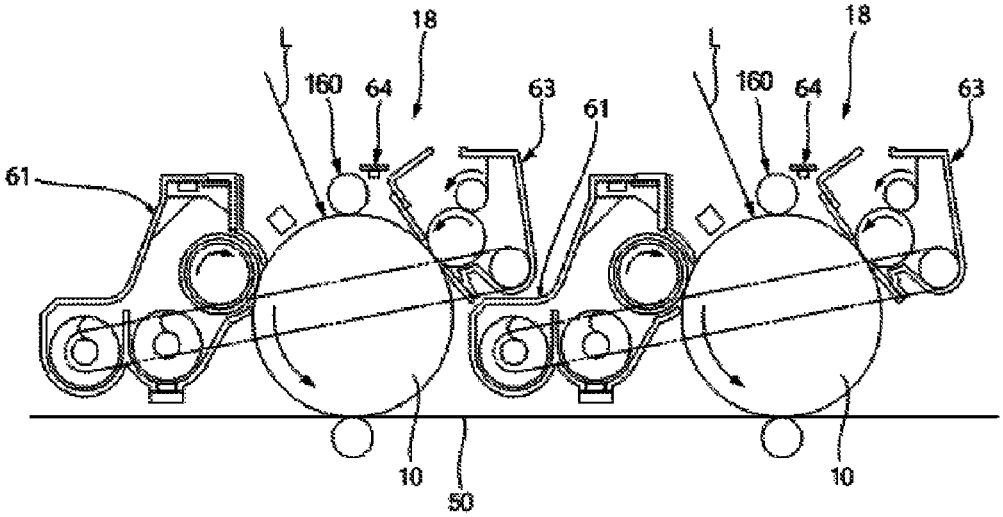
FIG. 7 is a partial exploded schematic view of the image forming apparatus shown in FIG. 6.

Furthermore, the black, yellow, magenta and cyan image information is delivered to the image-forming units 18 (the black image-forming unit, the yellow image-forming unit, the magenta image-forming unit and the cyan image-forming unit) in the tandem developing device 120 and the black, yellow, magenta and cyan toner images are formed in the various image-forming units. That is to say, the image-forming units 18 (the black image-forming unit, the yellow image-forming unit, the magenta image-forming unit and the cyan image-forming unit) in the tandem developing device 120 are each equipped, as shown in FIG. 7, with a photoconductor 10 (black photoconductor 10K, yellow photoconductor 10Y, magenta photoconductor 10M and cyan photoconductor 10C), an charging device 160 that charges the photoconductor uniformly, an exposure device that exposes the photoconductor to the color image corresponding image on the basis of the color image information (reference number L in FIG. 7) and forms an electrostatic image corresponding to the color images on the photoconductors, a developing device 61 that develops the electrostatic image using the various color toners (black toner, yellow toner, magenta toner and cyan toner) and forms a toner image with each color toner, a transfer charging device that transfers the toner image to the intermediate transfer unit 50, a photoconductor cleaning apparatus 63 and a charge elimination unit 64, so that the images of each color (black image, yellow image, magenta image and cyan image) can be formed on the basis of the respective color image information. The black image, yellow image, magenta image and cyan image thus formed are each successively transferred (first transfer) to the intermediate transfer unit 50, which is rotationally moved by the support rollers 14, 15, and 16, the black image having been formed on the black photoconductor 10K, the yellow image having been formed on the yellow photoconductor 10Y, the magenta image having been formed on the magenta photoconductor 10M and the cyan image having been formed on the cyan photoconductor 10C. Furthermore, the black image, yellow image, magenta image and cyan image are superimposed on each other on the intermediate transfer unit 50 and a composite color image (color transfer image) is formed.

On the other hand, in the paper supply table 200, one of the paper supply rollers 142 is selectively rotated, sheets (recording paper) are pulled from one of the paper supply cassettes 144, which are prepared in multiple stages in the paper bank 143, the sheets are separated one at a time by the separation roller 145 and sent to the paper supply route 146, are guided to the paper supply route inside the copy machine main body 150 by being fed by feeding roller 147, and are stopped by running into the resist roller 49. Or, the paper supply roller 52*a* is rotated, sheets (recording paper) are pulled from the manual feed tray 54, the sheets are separated one at a time by the separation roller 52 and enter the manual paper feed route 53, and similarly are stopped by running into the resist roller 49. The resist roller 49 is typically used by making contact, but in order to eliminate paper powder from the sheets, this may also be used by having a bias impressed. Furthermore, the resist roller 49 is caused to rotate with a timing coordinated with the composite color image (color transfer image) composed on the intermediate transfer unit 50, the sheets (recording paper) are fed between the intermediate transfer unit 50 and the second transfer apparatus 22, and a color image is transferred to and formed on the sheets (recording paper) by the composite color image (color transfer image) being transferred (second transfer) onto the sheets (recording paper) by the second transfer apparatus 22. The residual toner on the intermediate transfer unit 50 after image transfer is cleaned off by the intermediate transfer unit cleaning apparatus 17.

On the other hand, in the paper supply table 200, one of the paper supply rollers 142 is selectively rotated, sheets (recording paper) are pulled from one of the paper supply cassettes 144, which are prepared in multiple stages in the paper bank 143, the sheets are separated one at a time by the separation roller 145 and sent to the paper supply route 146, are guided to the paper supply route inside the copy machine main body 150 by being fed by feeding roller 147, and are stopped by running into the resist roller 49. Or, the paper supply roller 142 is rotated, sheets (recording paper) are pulled from the manual feed tray 54, the sheets are separated one at a time by the separation roller 145 and enter the manual paper feed route 53, and similarly are stopped by running into the resist roller 49. The resist roller 49 is typically used by making contact, but in order to eliminate paper powder from the sheets, this may also be used by having a bias impressed. Furthermore, the resist roller 49 is caused to rotate with a timing coordinated with the composite color image (color transfer image) composed on the intermediate transfer unit 50, the sheets (recording paper) are fed between the intermediate transfer unit 50 and the second transfer apparatus 22, and a color image is transferred to and formed on the sheets (recording paper) by the composite color image (color transfer image) being transferred (second transfer) onto the sheets (recording paper) by the second transfer apparatus 22. The residual toner on the intermediate transfer unit 50 after image transfer is cleaned off by the intermediate transfer unit cleaning apparatus 17.

The sheets (recording paper) onto which the color image has been transferred and formed is sent out from the second transfer apparatus 22 and fed into the fixing device 25, and in the fixing device 25, the composite color image (color transfer image) is fixed onto the sheets (recording paper) by heat and pressure. Following this, the sheets (recording paper) are switched by the switching hook 55 and ejected by the ejection roller 56 and are stacked in the paper output tray 57, or are switched by the switching hook 55, reversed by the sheet reversing apparatus 28 and against guided to the transfer position, and after an image has been recorded on the back surface also, are ejected by the ejection roller 56 and stacked in the paper output tray 57.

In the image forming method and image forming apparatus of the present invention, the toner structure can be controlled to realize both low-temperature fixing and heat resistance and to have offset resistance, and because these use the toner of the present invention, which offers excellent charging ability and suitability for cleaner-less apparatus without smearing the developing apparatus; thus high-quality images can be efficiently formed.

With the present invention, the foregoing problems can be resolved, control of the toner structure is possible such that both low-temperature fixing and heat resistance are realized and offset resistance is excellent, and a toner with excellent charging ability and suitability for cleaner-less apparatus without smearing the developing apparatus can be provided, along with a developer, toner container, process cartridge, image forming apparatus and image forming method all using that toner.

EXAMPLES

Examples the present invention will be descried below, which however shall not be construed as liming the scope of the present invention. In Examples below, "parts" and "%" are by mass unless otherwise indicated.

In the below-described Examples and Comparative Examples, measurements of the isocyanate group content ratio (NCO %), acid number, hydroxyl group number and glass transition temperature (Tg) were conducted in the manner described below. Note that methods of measuring average circularity, volume-average particle diameter (Dv), number-average particle diameter of particles (Dp), particle size distribution (Dv/Dp), and zeolite cation exchange capacity (CEC) have been discussed above.

<Measurement of Free Isocyanate Group Content Ratio (NCO %)>

The free isocyanate group content ratio (NCO %) is measured using a method conforming to JIS K1603.

<Measurement of Acid Number and Hydroxyl Group Number>

--Acid Number Measurement Method--

Measurement of acid number was accomplished under the following conditions in accordance with the measurement method noted in JIS K0070-1992.

Sample preparation: 0.5 g of toner (0.3 g for an ethyl acetate soluble component) was added to 120 ml of toluene, and is dissolved by agitation for around 10 hours at room temperature (23° C.). Furthermore, 30 ml of ethanol was added to yield a sample solution.

Measurement can be accomplished through calculations by the above-described apparatus, but specifically calculations are made as follows. The sample is titrated using a standardized N/10 caustic potassium alcohol solution, and the acid number is found using the following equation from the alcohol potassium solution consumption amount.

$$\text{Acid number} = \text{KOH (ml number)} \times N \times 56.1/\text{sample weight}$$

(where N is the factor of N/10 KOH)

--Hydroxyl Group Number Measurement Method--

A 0.5 g sample was precisely measured into a 100 ml mess flask, and to this 5 ml of an acetylated chemical was properly added. Following this, the mixture was immersed in a bath at 100° C.±5° C. and was heated. After 1-2 hours, the solution was removed from the flask and cooled, water was added and the mixture was shaken to decompose anhydrous acetic acid. Next, in order to make decomposition complete, the mixture was again heated in the flask for 10 minutes or longer and then cooled, and the wall of the flask was washed with an organic solvent. The OH number of this liquid was found using the electrode by accomplishing electric potential difference titration with an N/2 potassium hydroxide ethyl alcohol solution (conforming to JIS K0070-1966).

<Glass Transition Temperature (Tg) Measurement>

The glass transition temperature (Tg) is determined specifically through the following procedures. As the measurement apparatus, the TA-60 WS and DSC-60 manufactured by SHIMADZU CORPORATION, and measurement was made under the measurement conditions shown below.

[Measurement Conditions]

Sample container: Aluminum sample pan (with lid)
Sample quantity: 5 mg
Reference: Aluminum sample pan (10 mg alumina)
Atmosphere: Nitrogen (flow rate 50 ml/min)
Temperature conditions
Start temperature: 20° C.
Temperature increase rate: 10° C./min
Ending temperature: 150° C.
Holding temperature: none
Temperature decrease rate: 10° C./min
Ending temperature: 20° C.
Holding temperature: none
Temperature increase rate: 10° C./min
Ending temperature: 150° C.

The measurements were analyzed on data analysis software (TA-60, version 1.52) made by SHIMADZU CORPORATION. The analysis method was to designate a range of ±5° C. centered on a point showing the maximum peak on the lowest temperature side of the DrDSC curve, which is the DSC differential curve for the second temperature increase, and finding the peak temperature using the analysis software's peak analysis function. Next, the maximum heat absorption temperature on the DSC curve is found using the peak analysis function of the analysis software in the range of +5° C. and −5° C. of the peak temperature on the DSC curve. The temperature indicated here is equivalent to the glass transition temperature (Tg) of the toner.

Example 1

Synthesis of Polyester 1

In a reaction vessel equipped with a cooling tube, an agitator and a nitrogen introduction tube, 553 parts of 2 mole ethylene oxide adduct of bisphenol A, 196 parts of 2 mole propylene oxide adduct of bisphenol A, 220 parts of terephthalic acid, 45 parts of adipic acid and 2 parts of dibutyltin oxide were reacted for eight hours at 230° C. and normal pressure, then reacted further for 5 hours at reduced pressure of 10-15 mmHg, after which 46 parts of anhydrous trimellitic acid was poured into the reaction vessel and the mixture was reacted for two hours at 180° C. at normal pressure to obtain [Polyester 1]. [Polyester 1] had a number-average molecular weight of 2,200, weight-average molecular weight of 5,600, glass transition temperature (Tg) of 43° C. and acid number of 13 mgKOH/g.

--Synthesis of Polymers--

In a reaction vessel equipped with a cooling tube, an agitator and a nitrogen introduction tube, 682 parts of 2 mole ethylene oxide adduct of bisphenol A, 81 parts of 2 mole propylene oxide adduct of bisphenol A, 283 parts of terephthalic acid, 22 parts of anhydrous trimellitic acid and 2 parts of dibutyltin oxide were reacted for eight hours at 230° C. and normal pressure, then reacted further for 5 hours at reduced pressure of 10-15 mmHg to yield [Intermediate polyester 1]. [Intermediate polyester 1] had a number-average molecular weight of 2,100, weight-average molecular weight of 9,500, Tg of 55° C., acid number of 0.5 mgKOH/g, and hydroxyl group number of 49 mgKOH/g.

Next, in a reaction vessel equipped with a cooling tube, an agitator and a nitrogen introduction tube, 411 parts of [Intermediate polyester 1], 89 parts of isophorone diisocyanate and 500 parts of ethyl acetate were reacted for 5 hours at 100° C. to obtain [Prepolymer 1]. The content of free isocyanate in the resulting [Prepolymer 1] was 1.53%.

--Synthesis of Master Batch--

Forty parts of carbon black (LEGAL 400R, made by CABOT CORPORATION), 60 parts of polyester resin (made by SANYO INDUSTRIES LTD., RS-801, acid number 10 mgKOH/g, weight-average molecular weight of 20,000, glass transition temperature (Tg) 64° C.) and 30 of parts water were combined in HENSCHEL MIXER to obtain a mixture in which water had soaked into a pigment condensate. This was kneaded for 45 minutes by two rollers with the roller surface temperature set to 130° C. and milled to a size of 1 mm in diameter with a pulverizer to yield Next, 1,500 parts of [Raw material solution 1] was moved to a container and using a bead mill (ULTRA VISCO MILL made by IMEX CO., LTD.), dispersion of carbon black and wax was accomplished under conditions of three passes at a solution feed rate of 1kg/hour and a disk circumference speed of 6 m/second with 0.5 mm zirconia beads filled to 80% volume. [Master batch 1].

Example 1

Preparation of Pigment and Wax Dispersion Liquid (Oil Phase)

A container equipped with a stirrer and thermometer was charged with 378 parts of [Polyester 1], 120 parts of paraffin wax (HNP9) and 1,450 parts of ethyl acetate. The temperature in the container was raised to 80° C. with agitation, kept at 80° C. for five hours, and decreased to 30° C. over 1 hour by cooling. Next, 500 parts of [Master batch 1] and 500 parts of ethyl acetate were prepared in the container and mixed for one hour to yield [Raw material solution 1].

Next, 1,500 parts of [Raw material solution 1] was moved to a container and using a bead mill (ULTRA VISCO MILL made by IMEX CO., LTD.), dispersion of carbon black and wax was accomplished under conditions of three passes at a solution feed rate of 1 kg/hour and a disk circumference speed of 6 m/second with 0.5 mm zirconia beads filled to 80% volume.

Next, 655 parts of a 65% ethyl acetate solution of [Polyester 1] was added and [Pigment/wax dispersion solution 1] was obtained by one pass with the beads mill under the above-described conditions. Ethyl acetate was added so that [Pigment/wax dispersion solution 1] has a solid content (130° C., 30 minutes) of 50%.

--Water Phase Preparation--

A milky white-colored liquid was obtained by mixing together and agitating 953 parts of ion exchange water, 88 parts of 25% aqueous dispersion liquid of organic resin fine particles used in stabilizing dispersions (a sodium chloride copolymer of ester sulfide adduct of styrene-methacrylate-butyl acrylate-ethylene oxide methacrylate), 90 parts of 48.5% aqueous solution of sodium dodecyldiphenyl ether disulfonate (ELIMINOL MON-7, made by SANYO SHEMICAL INDUSTRIES LTD.) and 113 parts of ethyl acetate.

--Emulsification Process--

Here, 967 parts of [Pigment/wax dispersion solution 1] and 6 parts of isophorone diamine as an amine were combined, and synthetic zeolite shown in Table 1 was added in an amount of 1.0% (in terms of toner solids), followed by mixing for 1 minute at 5,000 rpm with TK HOMO MIXER (made by TOKUSHU KIKA KOGYO). Thereafter, 137 parts of [Prepolymer 1] was added, the resultant mixture was mixed for 1 minute at 5,000 rpm with TK HOMO MIXER (made by TOKUSHU KIKA KOGYO), and then 1,200 parts of [Water phase 1] was added and mixed for 20 minutes at 8,000-13,000 rpm using TK HOMO MIXER to yield [Emulsified slurry 1].

--Desolvation--

The [Emulsified slurry 1] was poured into a container equipped with an agitator and thermometer, solvent removal was conducted for 8 hours at 30° C., and through this [Dispersion slurry 1] was obtained.

--Washing and Drying--

After 100 parts of [Dispersion slurry 1] was filtered at reduced pressure, washing and drying was accomplished as follows.

(1) 100 parts of ion exchange water was added to filter cake and filtered after being mixed by TK HOMO MIXER (for 10 minutes at 12,000 rpm).

(2) 900 parts of ion exchange water was added to the filter cake of (1) and after ultrasonic vibrations were applied and the mixture was mixed with a TK HOMO MIXER (for 30 minutes at 12,000 rpm), the mixture was filtered at reduced pressure. This operation was repeated so that the electrical conductivity of the reslurry solution (filter cake) became 10 μC/cm or less.

(3) 10% hydrochloric acid was added so that the pH of the reslurry solution of (2) became 4, and the result was agitated for 30 minutes with a three-one motor and then filtered.

(4) 100 parts of ion exchange water was added to the filter cake of (3) and the result was mixed with a TK HOMO MIXER (for 10 minutes at 12,000 rpm) and then filtered. This operation was repeated so that the electrical conductivity of the reslurry solution (filter cake) came 10 μC/cm or less, yielding [Filter cake 1].

The [Filter cake 1] was dried for 48 hours at 45° C. in a circulating dryer and then screened with a 75 μm mesh to yield [Toner 1]. The resulting [Toner 1] had a volume-average particle diameter (Dv) of 6.0 μm and number average particle diameter of particles (Dp) of 5.3 μm, the Dv/Dp was 1.13, and the average circularity was 0.981.

Next, 100 parts of this base toner was mixed together with 0.5 parts of hydrophobic silica and 0.5 parts of hydrophobic titanium oxide using HENSCHEL MIXER to yield [Developer 1].

Examples 2 to 6

Toners and developers of Examples 2 to 6 were produced in the same manner as that of Example 1 except that the type and amount of zeolite was changed as shown in Table 1.

Comparative Example 1

The toner and developer of Comparative Example 1 were produced the same as Example 1 other than that synthetic zeolite 1 was not added.

Comparative Examples 2 to 5

Toners and developers of Comparative Examples 2 to 5 were produced in the same manner as that of Example 1 except that complex inorganic oxides shown in Table 1 were added in place of synthetic zeolite 1.

Comparative Example 6

The toner and developer of Comparative Example 6 were obtained in the same manner as that of Example 1 except that the toner was produced by adding 2.0% synthetic zeolite 1 using the below-described pulverization method.

<Production of First Binder Resin>

As vinyl monomers, 600 g of styrene, 110 g of butyl acrylate and 30 g of acrylic acid were poured into a drip funnel together with 30 g of dicumyl peroxide as a polymerization initiator. Out of the polyester monomers, as polyols 1230 g of polyoxy propylene (2,2)-2,2-bis(4-hydroxy phenyl) propane, 290 g of polyoxy ethylene (2,2)-2,2-bis(4-hydroxy phenyl) propane, 250 g of isododecenyl succinic acid anhydride, 310 g of terephthalic acid, 180 g of 1,2,4-benzene tricarboxylic acid anhydride; as an esterization catalyst, 7 g of dibutyl tin oxide; as a wax, 340 g (11.0 parts by mass with respect to 100 parts of the prepared monomer) of paraffin wax (melting point 73.3° C., with 4° C. as the half-value magnitude of heat-absorption peak when the temperature is rising, as measured by a differential scanning calorimeter) were placed in a five-liter, four-opening flask equipped with a thermometer, stainless steel agitator, pouring-type condenser and nitrogen introduction tube. The result was agitated at a temperature of 160° C. in a nitrogen atmosphere in a mantle heater and the mixture of the vinyl monomer resins and polymerization initiators was dripped from the drip funnel for one hour. After the polymerization reaction was allowed to mature for two hours with the temperature maintained at 160° C., the temperature was increased to 230° C. and a polycondensation reaction was accomplished. The degree of polymerization was traced through the softening point measured using a fixed load extrusion fine tube rheometer, and the reaction was concluded when the desired softening point was achieved, and thereby the first binder resin was obtained. The resin softening point was 130° C.

<Production of Second Binder Resin>

As polyol 2210 g of polyoxy propylene (2,2)-2,2-bis(4-hydroxy phenyl) propane, 850 g of terephthalic acid, 120 g of 1,2,4-benzene tricarboxylic acid anhydride and, as an esterization catalyst, 0.5 g of dibutyl tin oxide were poured into a five-liter, four-opening flask equipped with a thermometer, stainless steel agitator, pouring-type condenser and nitrogen introduction tube, and a polycondensation reaction was accomplished by raising the temperature to 230° C. in a nitrogen atmosphere in a mantle heater. The degree of polymerization was traced through the softening point measured using a fixed load extrusion fine tube rheometer, and the reaction was concluded when the desired softening point was achieved, and thereby the second binder resin was obtained. The resin softening point was 115° C.

<Production of Toner Particles>

To 100 parts of a binder resin composed of the first and second binder resins (including the weight of the added wax) was added a master batch in an amount equivalent to 4 parts of C.I. Pigment Red 57-1, and mixed thoroughly using HENSCHEL MIXER. The mixture was melted and kneaded using a twin-screw kneader/extruder (PCM-30, made by IKEGAI TEKKO CO., LTD.) and the resulting kneaded product was rolled to a thickness of 2 mm by a cold press roller and cooled into a cold pellet, followed by crude pulverization using a feather mill. Following this, fine pulverization to an average particle diameter of 10 μm to 12 μm was accomplished using a mechanical pulverizer (KTM, made by KAWASAKI HEAVY INDUSTRIES LTD.), and furthermore after being pulverized while being rough sorted by a counter jet mill (AFG, made by HOSOKAWA MICRON LTD.), fine powder sorting was accomplished using a rotor sorter (100 ATP TEEPLEX sorter, made by HOSOKAWA MICRON LTD.), and colored resin particles 1 were obtained. The toner of Comparative Example 6 had a volume-average particle diameter (Dv) of 6.1 μm and average circularity of 0.922.

Table 1 summarizes production methods, compositions, and physical properties of the toners of Examples 1 to 6 and Comparative Examples 1 to 6.

TABLE 1

| | | Complex inorganic compound | | | Toner properties | |
|---|---|---|---|---|---|---|
| | Production method | Type | CEC (meq/100 g) | Additive amount (%) | Volume-average particle diameter (μm) | Average circularity |
| Example 1 | O/W type granulation | Synthetic zeolite 1 | 450 | 1.0 | 6.0 | 0.981 |
| Example 2 | O/W type granulation | Synthetic zeolite 1 | 450 | 2.0 | 6.2 | 0.982 |
| Example 3 | O/W type granulation | Synthetic zeolite 1 | 450 | 3.0 | 6.2 | 0.975 |
| Example 4 | O/W type granulation | Synthetic zeolite 2 | 600 | 2.0 | 6.1 | 0.980 |
| Example 5 | O/W type granulation | Artificial zeolite | 320 | 3.0 | 6.2 | 0.972 |
| Example 6 | O/W type granulation | Synthetic zeolite 1 | 450 | 5.0 | 6.2 | 0.970 |
| Comparative Example 1 | O/W type granulation | — | — | — | 6.0 | 0.982 |
| Comparative Example 2 | O/W type granulation | APA | 120 | 1.0 | 6.3 | 0.953 |
| Comparative Example 3 | O/W type granulation | APA | 120 | 2.0 | 6.2 | 0.932 |
| Comparative Example 4 | O/W type granulation | Bentonite | 115 | 2.0 | 6.2 | 0.941 |
| Comparative Example 5 | O/W type granulation | Sepiolite | 12 | 2.0 | 6.2 | 0.970 |
| Comparative Example 6 | Pulverization | Synthetic zeolite 1 | 450 | 2.0 | 6.1 | 0.922 |

Note that the official names for the complex inorganic compounds listed in Table 1 are as follows:

Synthetic zeolite 1: ZEOLAM A-3 (manufactured by TOSOH CORPORATION)

Synthetic zeolite 2: A-TYPE synthetic zeolite (manufactured by ASAHI GLASS Co., Ltd.)

Artificial zeolite: ZEOSTAR (manufactured by NIPPON CHEMICAL INDUSTRIAL CO., LTD.)

APA: layer-structured inorganic compound (manufactured by CLAYTON CO., LTD)

Bentonite: KUNIPIA F (manufactured by KUNIMINE INDUSTRIES Co., Ltd.)

Sepiolite: PANSIL (manufactured by GRUPO TOLSA)

Toners and developers of Examples 1 to 6 and Comparative Examples 1 to 6 were evaluated for the fixing and separation properties, transferability, anti-stress properties, image density, soiling, and suitability for cleaner-less apparatus in the manner described below. The results are shown in Table 2.

<Fixing and Separation Properties>

With toner (developer) on which an external additive treatment had been performed, an unfixed image on which a solid strip image (toner deposition amount =9 g/m$^2$) with a 3 mm top margin and 36 mm width had been printed was produced on A4 size paper fed vertically, using an image forming apparatus (IPSIO CX2500, made by Ltd. RICOH COMPANY, LTD.). This unfixed image was fixed at fixing temperatures in 10° C. increments in the range of 130° C. to 190° C., and the separation possible/non-offset temperature range was found. From this temperature range, evaluation was conducted based on the below-described criteria. The temperature range is the fixing temperature range in which separation of the paper from the heating roller can be accomplished well, no offset phenomenon occurs and the image does not peel off easily. The paper used and paper feed direction were vertically fed horizontal-fiber paper with 45 g/ m$^2$ which is disadvantageous for separation. The fixing device speed was 120 mm/second.

[Evaluation Criteria].

A: The separation possible/non-offset temperature range was 50° C. or higher

B: The separation possible/non-offset temperature range was 30° C. or higher but less than 50° C.

C: The separation possible/non-offset temperature range was less than 30° C.

<Transferability>

Using a toner (developer) treated with an external additive, a predetermined print pattern with 6% B/W ratio was continuously printed under an N/N environment (23° C., 45%) using an image forming apparatus (IPSIO CX2500, made by Ricoh Company. Ltd. RICOH COMPANY, LTD.). After continuously printing 2,000 copies under an N/N environment (after durability), the toner on the photoconductor in solid pattern printing of set surface area was absorbed and the mass (A) of the absorbed toner was measured. On the other hand, the toner on the paper prior to fixing was absorbed and the mass (B) was measured. The transfer efficiency (%) was found from the following equation: (A)/(B)×100. From the value of this transfer efficiency, evaluation was conducted in the following three grades.

[Evaluation Criteria]

A: Transfer efficiency of 85% or higher

B: Transfer efficiency of 75% or higher but less than 85%

C: Transfer efficiency of less than 75%.

<Stress Resistance, Image Density and Soiling>

Using a toner (developer) treated with an external additive treatment, a predetermined print pattern with 6% B/W ratio was continuously printed under an N/N environment (23° C., 45% RH) using an image forming apparatus (IPSIO CX2500, made by RICOH COMPANY, LTD.).

(1) Stress Resistance

After continuously printing 50 copies and 2,000 copies under an N/N environment (after durability), the toner on the developing roller in white paper pattern printing was absorbed, the electric charge was measured using an electrometer, the difference in charge between after 50 copies and after 2,000 copies was found and the results were evaluated using the following three grades:

[Evaluation Criteria]

A: Absolute value of the charge difference is less than 10 μC/g

B: Absolute value of the charge difference is 10 μC/g to 15 μC/g

C: Absolute value of the charge difference is in excess of 15 μC/g (2) Image Density and Soiling The image density was visually evaluated for a printed sample after 2,000 copies of continuous printing. For soiling of the photoconductor, colorless transparent tape was stuck to a non-cleaned part after developing, soiling toner was peeled off of the photoconductor and image density after attaching to white paper was evaluated visually. Evaluations made based on the following three scales.

[Evaluation Criteria]

A: Good

B: Not to a level that would cause problems in actual usage

C: Actual usage impossible.

<Evaluation of Suitability for Cleaner-Less Apparatus>

Using toners (developers) treated with an external additive in a manner similar to that described above were employed. The charging roller of an image forming apparatus (IPSIO CX3000, manufactured by RICOH COMPANY, LTD.) was replaced by a brush roller, and the photoconductor cleaning blade was removed and a conductive sheet was placed on the photoconductor surface where the cleaning blade had been removed. In this way a remodeled cleaner-less image forming apparatus shown in FIG. 10 was obtained.

Figure 10:
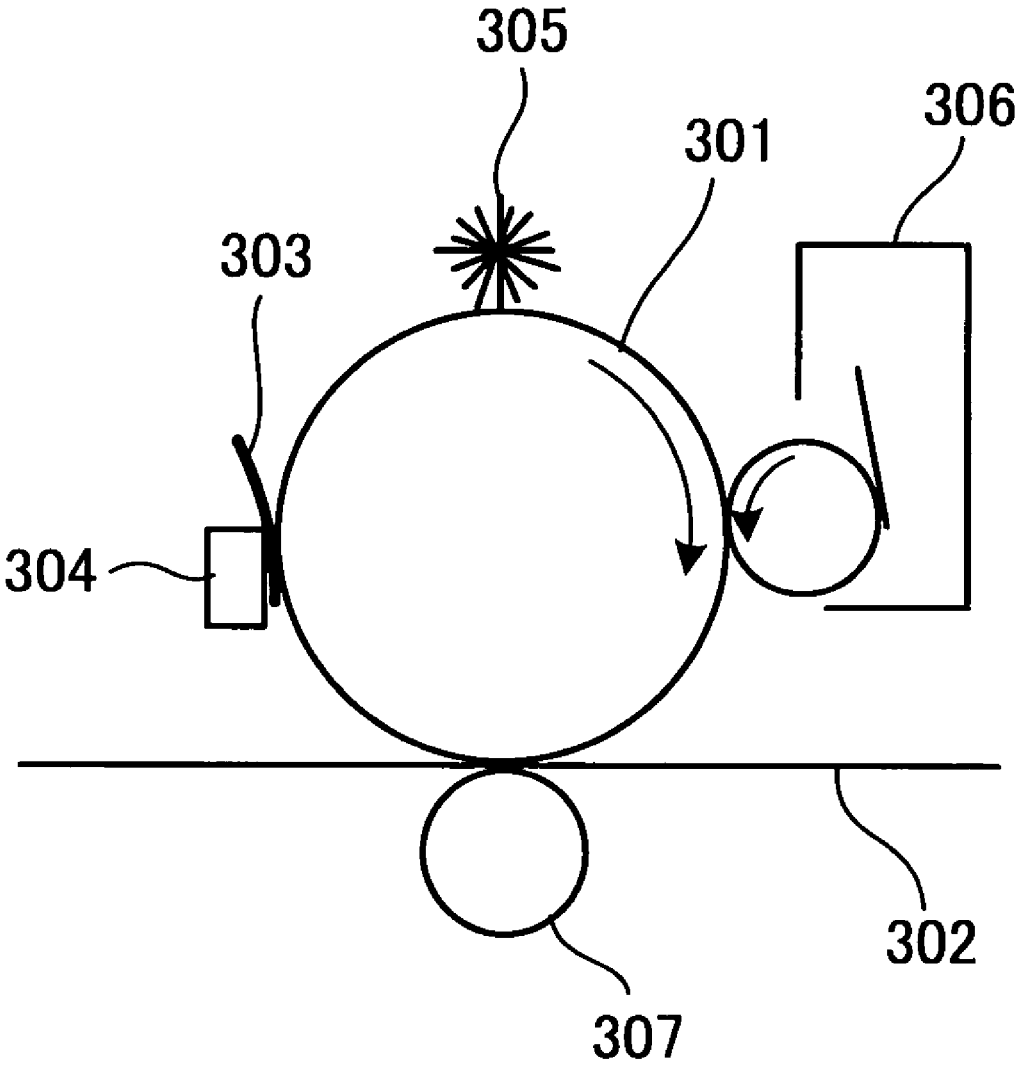
FIG. 10 is a schematic view showing an example of a cleaner-less image forming apparatus used in Examples of the present invention.

In FIG. 10 reference numeral 301 denotes a latent electrostatic image bearing member; 302, transfer belt; 303, conductive sheet; 304, elastic part; 305, charging brush; 306, developing unit; and 307, transferring roller. The conductive sheet 303 is made of PTFE, with thickness being 0.1 mm, resistance being $10^5$ Ωcm, nip width being 5 mm, and sheet voltage being DC 500V.

The charging brush 305 is made of nylon 6, with thickness being 2d, resistance being $10^6$ Ωcm, density being 260,000 pieces/inch$^2$, brush outer diameter being 11 mm, shaft diameter being 5 mm, amount of depth in the photoconductor surface being 0.8 mm, circumferential speed ratio being 2, AC voltage peak being 1.0 kV, Duty being 45% (PC potential=0V), and frequency being 500 Hz.

A predetermined print pattern with 6% B/W ratio was continuously printed under an N/N environment (23° C., 45% RH) on this cleaner-less image forming apparatus in monochrome print mode. After continuous printing of 2,000 copies of the pattern, the degree of toner cake on the conductive sheet was evaluated based on the following criteria as an evaluation of suitability for cleaner-less apparatus.

[Evaluation Criteria]

A: No cakes on the conductive sheet

B: A little cake on the conductive sheet (image disturbance is seen)

C: A severe amount of cake on the conductive sheet (remarkable image disturbance is seen)

TABLE 2

| | Soiling | Image density | Transferability | Stress resistance | Fixing and separation | Suitability for cleaner-less apparatus |
|---|---|---|---|---|---|---|
| Example 1 | B | A | A | A | A | A |
| Example 2 | A | A | A | A | A | A |
| Example 3 | A | A | A | A | A | A |
| Example 4 | A | A | A | A | A | A |
| Example 5 | A | A | B | A | A | A |
| Example 6 | B | A | B | B | A | A |
| Comparative Example 1 | C | C | C | A | A | A |
| Comparative Example 2 | A | A | C | B | A | C |
| Comparative Example 3 | A | B | C | B | A | C |
| Comparative Example 4 | B | B | C | C | A | C |
| Comparative Example 5 | C | C | C | B | A | A |
| Comparative Example 6 | B | A | C | C | C | C |

From the results of Table 2, it can be seen that fixing and separation, transferability, stress resistance and suitability for cleaner-less apparatus are excellent and there is no reduction of image density nor occurrence of soiling in Examples 1-6, which use toner containing zeolite and which is produced by O/W type wet granulation. In particular, it can be seen that transferability and stress resistance were excellent in Examples 1-4, in which 0.2 parts to 2.5 parts of synthetic zeolite having a CEC of 400-600 (meq/100 g) was added to 100 parts of the toner.

The toner of the present invention realizes both low-temperature fixing and heat resistance, has excellent offset resistance and the toner structure can be controlled, and has good charging ability and suitability for cleaner-less apparatus without soiling the developing apparatus, and hence can be ideally used in high-quality image formation. Furthermore, the developer, toner container, process cartridge, image forming apparatus and image forming method of the present invention that use the toner of the present invention can be ideally used in forming of high-quality electrophotographic images.

What is claimed is:

1. A toner comprising:

a binder resin, a colorant, a releasing agent, and zeolite, wherein the toner is manufactured through O/W wet granulation and has an average circularity of 0.970 or greater and a cation exchange capacity (CEC) of the zeolite is 150 meq/100 g to 800 meq/100 g.

2. The toner according to claim 1, wherein the toner has a negative charge.

3. The toner according to claim 1, wherein the zeolite is a synthetic zeolite having a cation exchange capacity (CEC) of 400 meq/100 g to 600 meq/100 g.

4. The toner according to claim 1, wherein the binder resin comprises polyester resin.

5. The toner according to claim 1, wherein an oil phase material used in the O/W wet granulation comprises an organic solvent.

6. A developer comprising the toner of claim 1.

7. An image forming method comprising:

forming a latent electrostatic image on a latent electrostatic image bearing member;

developing the latent electrostatic image using the toner of claim 1 to form a visible image;

transferring the visible image to a recording medium; and fixing the visible image to the recording medium.

8. The image forming method according to claim 7, further comprising:

re-charging residual toner particles left on the latent electrostatic image bearing member after the transferring step by use of a re-charging member, wherein a cleaner-less system is employed in which the residual toner particles are recovered along with development of the latent electrostatic image formed on the latent electrostatic image bearing member.

9. The image forming method according to claim 8, wherein the re-charging member is a conductive sheet provided in such a manner as to be pressed against a surface of the latent electrostatic image bearing member.

* * * * *